US007803071B2

(12) United States Patent
Stanford et al.

(10) Patent No.: US 7,803,071 B2
(45) **Date of Patent: *Sep. 28, 2010**

(54) SPORTS SYSTEM

(75) Inventors: Carl R. Stanford, Clearfield, UT (US); Sharon Jones, Clearfield, UT (US); Robert A. Astle, Farmington, UT (US); Wendell Peery, Kaysville, UT (US); Danny Green, Layton, UT (US); Gary Phillips, Clearfield, UT (US); S. Curtis Nye, Clinton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 324 days.

This patent is subject to a terminal disclaimer.

(21) Appl. No.: 11/759,900

(22) Filed: Jun. 7, 2007

(65) Prior Publication Data

US 2007/0287560 A1 Dec. 13, 2007

Related U.S. Application Data

(60) Provisional application No. 60/860,521, filed on Nov. 21, 2006, provisional application No. 60/812,480, filed on Jun. 10, 2006.

(51) Int. Cl.
*A63B 63/08* (2006.01)

(52) U.S. Cl. ..... 473/479; 473/481; 473/483

(58) Field of Classification Search ..... 473/479–483; 404/10; 403/362; 264/515, 516, 508, 219; 156/254; 116/209
See application file for complete search history.

(56) References Cited

U.S. PATENT DOCUMENTS 234,576 A 11/1880 Hulings
4,145,044 A * 3/1979 Wilson et al. ..... 473/483
4,187,276 A 2/1980 Amberg
4,207,284 A * 6/1980 Speas ..... 264/516
4,378,328 A * 3/1983 Przytulla et al. ..... 264/534
5,018,642 A * 5/1991 Pyzytulla ..... 220/675
5,082,261 A 1/1992 Pelfrey
5,248,140 A 9/1993 Mower et al.

(Continued)

OTHER PUBLICATIONS

NPL-Escalade,The Big Easy Owners Manual 2003,www.escaladesports.com/pdf/2l-6541-03.pdf, 9 pages.*

(Continued)

*Primary Examiner*—Gene Kim
*Assistant Examiner*—M Chambers
(74) *Attorney, Agent, or Firm*—Workman Nydegger

(57) ABSTRACT

A sports system may include a base and a support structure that is sized and configured to support a goal, such as a netball goal or a basketball goal, at a height above a playing surface. The base may be constructed from plastic and may include a hollow interior portion that is sized and configured to receive ballast. The base may also include a protrusion that is sized and configured to abut a support surface and the protrusion may have an at least substantially solid construction. The sports system may further include a brace that may be connected to the support structure and the base. The brace may be disposed through an opening formed in the base and it may be connected to the base by a sleeve and a pin that is disposed within a receiving portion formed in the base.

30 Claims, 22 Drawing Sheets

U.S. PATENT DOCUMENTS

| | | | | |
|---|---|---|---|---|
| D351,879 | S | 10/1994 | Matherne et al. | |
| D351,881 | S | 10/1994 | Taylor et al. | |
| D351,882 | S | 10/1994 | Taylor et al. | |
| 5,836,838 | A | 11/1998 | van Nimwegen et al. | |
| 6,098,833 | A * | 8/2000 | von Holdt et al. | 220/659 |
| 6,136,259 | A | 10/2000 | Puffenberger et al. | |
| 6,432,003 | B1 | 8/2002 | van Nimwegen | |
| 6,776,734 | B2 | 8/2004 | van Nimwegen | |
| 6,866,596 | B2 | 3/2005 | Steed et al. | |
| 7,044,867 | B2 | 5/2006 | van Nimwegen et al. | |
| 7,118,500 | B2 | 10/2006 | Nye et al. | |
| 7,341,314 | B1 | 3/2008 | Boyd | |
| 2004/0176195 | A1 * | 9/2004 | Nye et al. | 473/479 |

OTHER PUBLICATIONS

Examination Report from Australian Patent Application No. 2007202688, dated Dec. 23, 2008, 2 pages.

International Search Report and Written Opinion from PCT/US2007/070791, dated Oct. 27, 2008.

Office Action dated Jun. 10, 2009 from U.S. Appl. No. 11/838,844.

Escalade B3306 Owners Manual, 2003, pp. 1-9.

International Search Report and Written Opinion from PCT/US2007/070791, dated Oct. 17, 2008, 11 pages.

* cited by examiner

SPORTS SYSTEM

CROSS-REFERENCE TO RELATED APPLICATIONS

This application claims priority to and the benefit of U.S. provisional patent application Ser. No. 60/812,480, which was filed Jun. 10, 2006 and entitled NETBALL SYSTEM.

This application claims priority to and the benefit of U.S. provisional patent application Ser. No. 60/860,521, which was filed Nov. 21, 2006 and entitled NETBALL SYSTEM.

These applications are each incorporated by reference in their entireties.

BACKGROUND OF THE INVENTION

1. Field of the Invention

The present invention generally relates to sports equipment and, in particular, to a sports system that may be used in connection with a basketball.

2. Description of Related Art

The game of basketball typically includes a flat and level playing surface with a basketball goal at each end of the court. The basketball goal, which may include a backboard and a rim or hoop, is typically attached to the top of a support pole. The rim or hoop is normally located ten feet above the playing surface and the backboard is constructed from materials such as wood, plastic or tempered glass.

Basketball is a very popular game and many people desire to play basketball at home. Many basketball systems designed for home use require the basketball goal be permanently fixed in a particular location. For example, many home basketball systems are permanently positioned on the edge of the driveway. Disadvantageously, mounting a basketball goal adjacent to the driveway of the home may create a risk of damage to cars using the driveway or cars that are parked nearby. In addition, one or more cars may have to be moved before the basketball goal may be used.

Permanent basketball systems designed for use at home may also be difficult to install. For example, concrete or asphalt may be located where it is desired to install the permanent basketball system. Accordingly, the concrete or asphalt may have to be removed and/or replaced to allow the basketball system to be installed. Undesirably, removing and/or replacing the concrete or asphalt may be difficult, time-consuming and expensive. In addition, this would most likely prevent use of the driveway during the period of construction and repair.

Permanent basketball systems that are installed at home are usually located outdoors and are exposed to the harsh elements of the weather throughout the entire year. Disadvantageously, when conventional permanent basketball systems are constantly exposed to the elements such as rain, snow, sleet, high temperatures and high humidity, various components of the basketball systems may prematurely oxidize, corrode or rust. Premature oxidation, corrosion and rust can be particularly troublesome in basketball systems that have any moving parts, such as height adjustment mechanisms or breakaway rim assemblies. Moreover, constant exposure to the elements may cause failure of such mechanisms.

It is also known to use permanent basketball systems indoors. Indoor basketball systems, however, require a large amount of space and must be located away from other structures to allow basketball to be played. For example, conventional indoor basketball systems must generally be spaced several feet away from the walls so that the walls do not interfere with playing basketball. These permanent basketball systems may limit or prevent the space from being used for other purposes. For example, schools typically have a gymnasium and basketball goals may be located near the ends or sides of the gymnasium. The basketball goals may undesirably preclude or interfere with use of the gymnasium for other purposes. In addition, on some occasions, objection may be made to the appearance and location of the permanently mounted basketball goals.

Portable basketball systems that are movable from one location to another location are also known. Conventional portable basketball systems typically require a large amount of weight so that the basketball goal remains in a generally rigid, upright position for use when playing basketball or shooting baskets. In particular, many conventional portable basketball systems require a large and heavy base to prevent the basketball system from undesirably moving. The large and heavy base, however, may make these basketball systems very difficult to move and may require the assistance of several people to set up or relocate the systems. Additionally, these known basketball systems are often relatively expensive and that may prohibit people from using these systems at home.

Conventional portable basketball systems may use removable weights, such as sand bags or metal weights, which help maintain the basketball systems in a fixed position. Disadvantageously, these removable weights can be extremely heavy, difficult to lift and hard to position in the desired location. Accordingly, although these basketball systems using removable weights may be easier to move in relation to permanently mounted goals, the weights or weighted members are often not easy to move, lift or position, which may limit the usefulness of the portable basketball systems.

In order to make portable basketball systems better suited for home use, large support bases with a hollow cavity for receiving ballast material, such as sand or water, were developed. These portable basketball systems may be moved into the desired location and then the support base may be filled with sand or water to add weight to the system, which would help prevent the system from undesirably moving during use. Disadvantageously, the large support bases of many conventional portable basketball systems were difficult to fill with sand or water.

Many conventional basketball systems also include large and/or heavy parts, which can be difficult to install. In addition, these large parts may increase the size of the packaging, which can further increase shipping costs. Further, some retail consumers may not have access to vehicles (such as trucks, sport utility vehicles or the like) that can transport the large packaging and thus may choose not to purchase the basketball systems.

Netball is a sport or activity that is similar to basketball and it is very popular in countries such as Australia and New Zealand. Netball is also played in various countries such as the United Kingdom, South Africa, Jamaica, Barbados and Sri Lanka. Like basketball, netball is played on a hard court with scoring rings or goals at both ends of the court. The netball generally resembles a basketball but it is typically lighter, smaller and slightly softer in construction. The netball goals have a smaller dimension and height in comparison to basketball goals, and the netball goals do not include backboards. The netball court is slightly larger than a basketball court, being 30.5 meters long and 15.25 meters wide. The longer sides of the netball court are called Side Lines and the shorter lines are called Goal Lines. The netball court is divided into thirds which regulates where individuals in each team are allowed to move. The netball court also includes two semi-circular "shooting circles" at each end from within which all scoring shots must be taken.

BRIEF SUMMARY OF EMBODIMENTS OF THE INVENTION

A need therefore exists for a sports system that eliminates or diminishes the disadvantages and problems described above.

One aspect is a sports system that may be used in connection with sports such as basketball, netball, volleyball, badminton system and the like. The sports system may include a support structure and a base that is sized and configured to support the support structure. The support structure may be sized and configured to support a goal, such as a netball goal or a basketball goal, at a desired height above a playing surface. The support structure may also be sized and configured to support other objects, such as volleyball nets, soccer nets, badminton nets, etc.

Another aspect is a sports system that may be selectively moved from one location to another location. Desirably, the sports system is part of a portable system that is readily capable of being moved. The portable sports system may be quickly and easily moved from one location to another, and the sports system may be capable of being moved by a single person. The sports system could also be a permanent or fixed system, if desired.

Yet another aspect is a sports system that may include a base. The base may include a hollow interior portion that is sized and configured to receive ballast, such as sand or water. The base is preferably constructed of relatively lightweight materials, such as blow-molded plastic. The base could also be manufactured from other suitable materials and processes.

Still another aspect is a sports system that may include a base that is sized and configured to contact a relatively large area. For example, the base may include an outer edge or lip that is sized and configured to contact a support surface, such as the ground or court. Preferably, the edge is disposed at or at least proximate the outer boundary of the base so that none or very little of the base overhangs or extends beyond the edge. Because the edge may be disposed at or proximate the outer perimeter of the base and the edge may contact the support surface, the base may be stable. In addition, the edge may support all or a portion of the weight of the base and/or sports system. If the edge is disposed at or proximate the perimeter of the base and it supports a significant amount of weight, then the stability of the base may be increased.

A further aspect is a sports system that may include a base with a length that is longer than the width. The length of the base preferably extends away from the support pole, which may help provide a greater resistance to undesired movement of the sports system. For example, the length of the base may be about twice the width of the base but it will be appreciated that the base could have any desired length, width, size, shape, configuration and arrangement.

A still further aspect is a sports system that may include a base with a height that is smaller than a base for a conventional basketball system. For example, the height of the base may be one-third, one-half or even smaller than the height of a base for a conventional basketball system. In addition, the height of the base may be significantly less than the width or the length of the base. For instance, the base may include a width of about two feet and a length of about three feet. The height of the base, however, may be much less than either the width or the length, such as about six inches or less. Of course, the base could have other suitable shapes, sizes, dimensions, configurations and arrangements depending, for example, upon the intended use of the sports system.

Yet another further aspect is a sports system that may be relatively lightweight, which may facilitate shipping, transportation and storage of the system. In addition, the system may be packaged within a relatively small, compact area and that may also facilitate shipping, transportation and storage. The relatively small, lightweight packaging may help reduce costs, for example, when shipping the system from the factory to the store. In addition, this may allow consumers to easily transport the system from the store to their house. Further, because the sports system may be relatively lightweight, that may facilitate quick and easy assembly of the system.

Another aspect is a sports system that may include a support structure, which may include a support pole. The support pole may consist of a unitary, one-piece structure or it may include multiple pieces. The support pole may be adjustable in length to allow the height of the sports system to be varied. For example, the support pole may include four pieces or sections that are interconnected. This may allow, for instance, the height to be adjusted between about 7.5 feet and about 10 feet, which may facilitate use of the system by adults, or between about 4 feet and about 6.5 feet, which may facilitate use of the system by children. The length of the support pole may be adjustable in any desired increments. The sports system may include a telescoping support pole or other suitable structure to allow the length of the support pole to be varied.

Yet another aspect is a sports system that may be affordable. For example, because the sports system may include relatively few parts and components, that may allow the cost of the system to be decreased. The sports system, however, may include any suitable number of parts and components, such as basketball backboards, nets and the like, depending, for example, upon the intended use of the sports system.

Advantageously, the sports system may be used in connection with various activities such as playing or practicing basketball or netball. The sports system may also be used in connection with youth systems and regulation size systems. Thus, the sports system may have a wide variety of uses, shapes, sizes, configurations and arrangements depending, for example, upon the intended use of the system.

Still another aspect is a sports system that may include a base, a rim and a support structure that is sized and configured to support the rim. The sports system may also include one or more braces that may be connected to the support structure and the base. For example, the braces may include a first portion connected to the support structure and a second portion connected to the base. In greater detail, the second portion of the brace may extend through a passage or opening in the base and may be secured to the base using, for instance, one or more positioning members. The positioning members may include a pin and/or a sleeve. The base may include receiving portions that are sized and configured to receive, retain and/or engage at least a portion of the positioning members using, for example, a snap, friction and/or interference fit. The receiving portions may be integrally formed in the base during a molding process (such as a blow-molding process), if desired. Advantageously, this may allow the connection of the braces to the base to be disposed below the top portion or surface of the base.

A further aspect is a sports system that may include base with an edge that extends along all or at least a portion of an outer perimeter of the base. The edge may include a downwardly extending lip and the lip may be sized and configured to contact the support surface so that the edge supports at least a portion of the weight of the base. Because the lip may be disposed at the outer perimeter of the base and it may support at least a portion of the weight of the base, a stable and secure base may be created. In addition, the lip may have a thickness that is generally equal to the thickness of the upper surface and the lower surface of the base. The increased thickness of the lip may allow the base to be securely supported and the lip my help protect the lower surface of the base from being damaged. In addition, this may create a long lasting base and it may be less likely to be damaged.

A still further aspect is a sports system that may include a support structure with two or more interconnected support members or poles. For example, the support structure may include a first support pole and a second support pole that are connected using, for example, a fastener. The fastener may include a bolt and a knob that is sized and configured to be connected to the bolt. The knob may include one or more protrusions, bumps, engaging members or the like that are sized and configured to contact, abut and/or engage at least one of the support poles. Desirably, the protrusions may help prevent the knob from inadvertently moving or turning. The knob preferably includes four protrusions, which are preferably generally rounded. The knob, however, may include more or fewer protrusions and the protrusions may have other suitable shapes.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a sports system. The principles of the present invention, however, are not limited to sports systems. It will be understood that, in light of the present disclosure, the sports system disclosed herein can be successfully used in connection with other purposes unrelated to sports.

Additionally, to assist in the description of the sports system, words such as top, bottom, front, rear, right and left may be used to describe the accompanying figures, which are not necessarily drawn to scale. It will be appreciated, however, that the sports system can be located in a variety of desired positions, angles and orientations. A detailed description of the sports system now follows.

Figure 1:
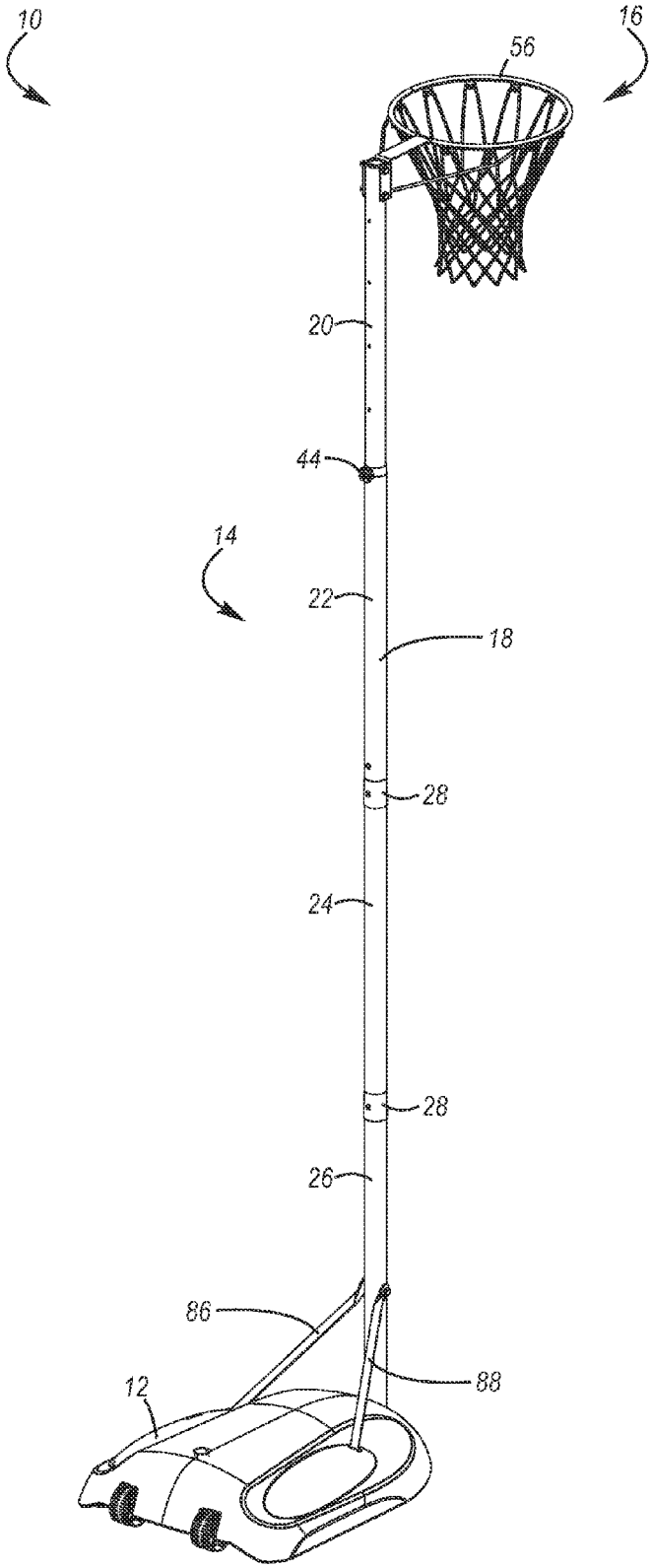
FIG. 1 is a perspective view of an exemplary sports system.

As shown in FIG. 1, a sports system 10 may form at least part of a netball system. Advantageously, the sports system 10 may include a limited number of components, which may help decrease the cost of the system. It will be appreciated, however, that the sports system 10 may include any suitable number of components and these various components can have an assortment of shapes, sizes, configurations and arrangements depending, for example, upon the intended use of the sports system. It will be appreciated that the sports system 10 may be used in connection with a variety of different systems and sports, such as basketball, volleyball, soccer, badminton and the like.

The sports system 10 is preferably sized and configured to be selectively moved from one location to another location. If desired, the sports system 10 may include one or more wheels to facilitate such movement, but wheels are not required. Desirably, the sports system 10 is a portable system that is readily capable of being moved. In particular, the sports system 10 may be quickly and easily moved from one location to another, and the sports system may be capable of being moved by a single person. On the other hand, the sports system 10 could be a permanent or fixed system if desired.

As shown in FIG. 1, the sports system 10 may include a base 12 and a support structure 14, which may be connected to the base. The support structure 14 may be sized and configured to support a goal, such as a netball goal 16 or a basketball goal, at a desired height above a playing surface. The support structure 14 may also be sized and configured to support at least a portion of net, such as a volleyball net, a soccer net, a badminton net or the like.

As shown in the accompanying figures, the base 12 may have a length that is longer than its width. The length of the base 12 may extend away from the support pole 18, which may help provide a greater resistance to undesired movement of the sports system 10. In addition, the length of the base 12 may allow a smaller base to be used and that may reduce shipping, storing and/or manufacturing costs. For instance, the length of the base 12 may be about twice the width of the base.

Desirably, the base 12 may have a height that is smaller than a base for a conventional sports system. For example, the height of the base 12 may be one-third, one-half or even smaller than the height of a base for a conventional basketball system. The decreased height of the base 12 may result in decreased manufacturing, shipping and/or storage costs. In addition, the base 12 may also have a relatively low profile. For example, the height of the base 12 may be significantly less than either the width or the length of the base. For instance, the base 12 may include a width of about two feet and a length of about three feet. The height of the base, however, may be much less than either the width or the length. In particular, the base 12 may have a height of about six inches or less. It will be appreciated that the base 12 may have any desired size, shapes, configuration and arrangement depending, for example, upon the intended use of the sports system 10.

Figure 2:
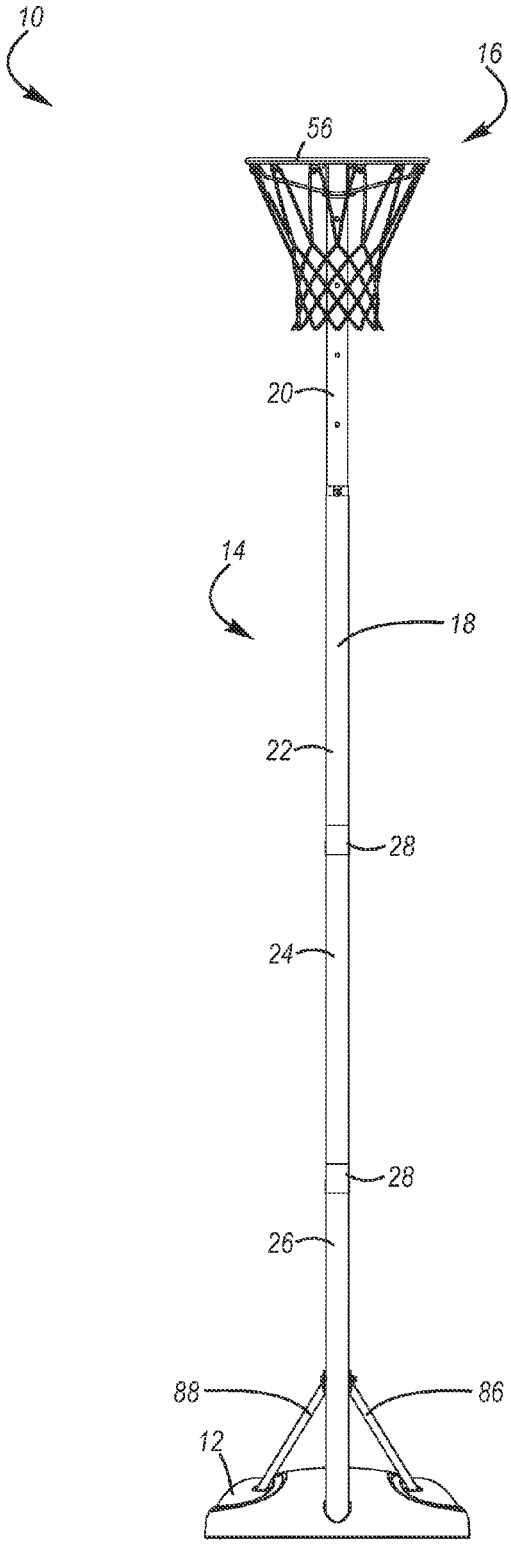
FIG. 2 is a front view of the sports system shown in FIG. 1.
Figure 5:
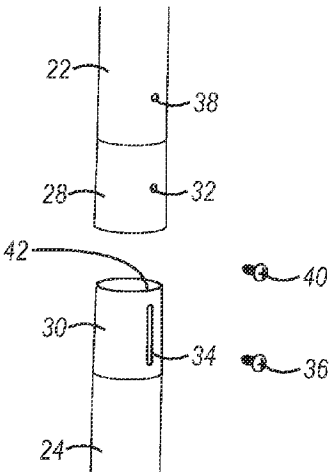
FIG. 5 is an exploded view of a portion of the sports system shown in FIG. 3.
Figure 4:
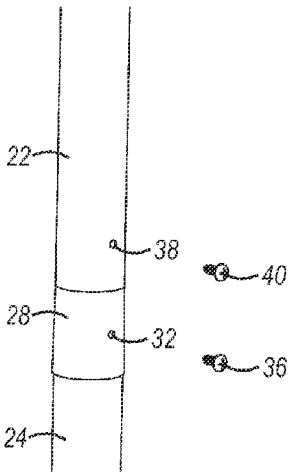
FIG. 4 is a partially exploded view of the portion of the sports system shown in FIG. 3.
Figure 3:
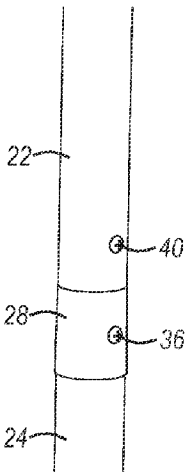
FIG. 3 is an enlarged view of a portion of the sports system shown in FIG. 1.
Figure 6:
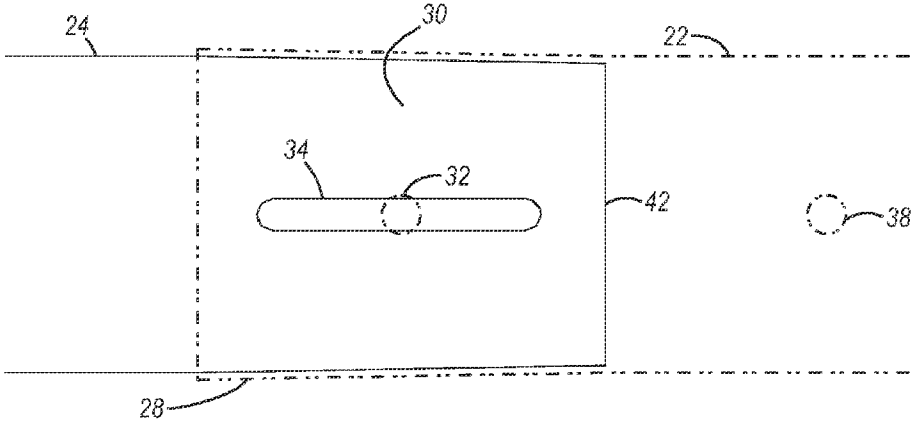
FIG. 6 is a side view of a portion of the sports system shown in FIG. 3.

The support structure 14 may include a support pole 18 and the support pole may consist of a single support member or may include a plurality of interconnected support members. For example, as seen in FIGS. 1 and 2, the support pole 18 may include four support members 20, 22, 24, 26. The support members 20, 22, 24, 26 may be constructed from metal tubes with a generally circular configuration, but the support members may be constructed from other materials with suitable characteristics and the support members may have other shapes, sizes, configurations and arrangements.

The support members 20, 22, 24, 26 of the support pole 18 may be interconnected using a friction or interference fit. For example, a first support member may include a flared portion that is sized and configured to receive and/or retain a tapered or swaged portion of a second support member. In particular, as shown in FIGS. 1-6, the support member 22 may include a flared portion 28 that is sized and configured to receive a tapered or swaged portion 30 of the support member 24. Likewise, the support member 24 may include a flared portion 28 sized and configured to receive a tapered or swaged portion 30 of the support member 24.

In addition, one or more fasteners (such as screws, bolts, rivets and the like) may be used to help align and/or interconnect the support members 20, 22, 24, 26. For example, as shown in FIGS. 3-6, the support members 22, 24 may include openings 32, 34 that are sized and configured to receive fasteners 36 to help align the support members. The opening 34 may have an elongated configuration, which may allow the support members 22, 24 to be aligned in a range of relative positions. The support member 22 may also include an opening 38 that is sized and configured to receive a fastener 40, which may help limit the relative movement of the support members 22, 24. In particular, at least a portion of the fastener 40 may inserted through the opening 38 and into a hollow interior of the support member 22. The inserted portion of the fastener 40 may be thus positioned to contact, abut and/or engage an upper edge 42 of the support member 24 to prevent the support member 24 from extending further into the support member 22.

Figure 8:
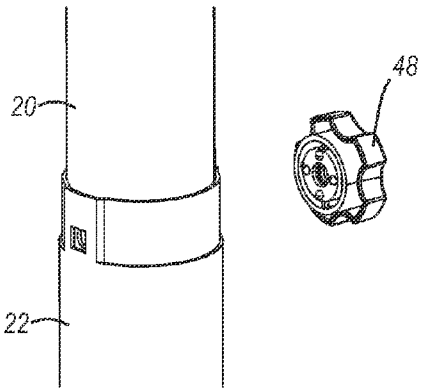
FIG. 8 is a partially exploded view of a portion of the sports system shown in FIG. 9 is an exploded view of a portion of the sports system shown in FIG. 7.
Figure 7:
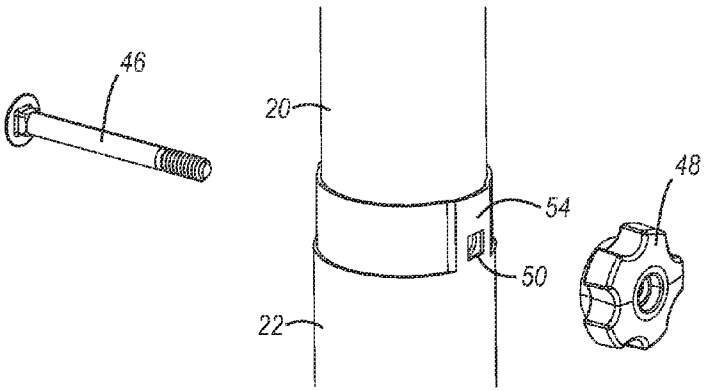
FIG. 7 is a partially exploded view of a portion of the sports system shown in FIG. 1.
Figure 9:
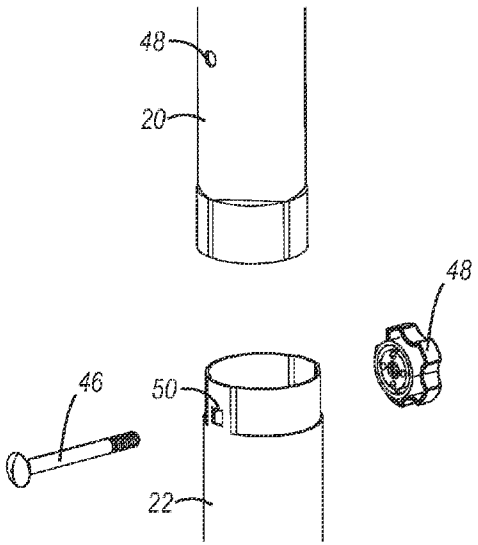
Figure 12:
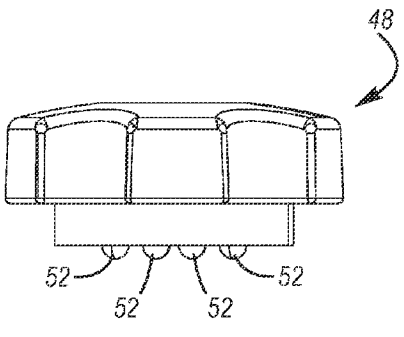
FIG. 12 is a side view of the knob shown in FIG. 10.
Figure 11:
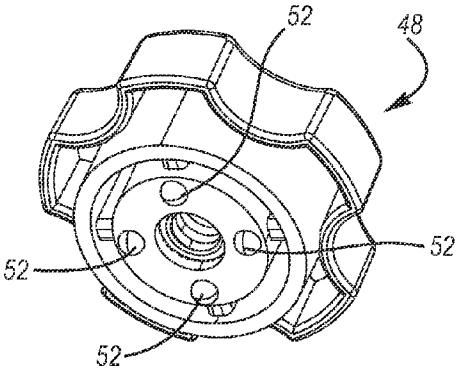
FIG. 11 is a perspective view of the knob shown in FIG. 10.
Figure 10:
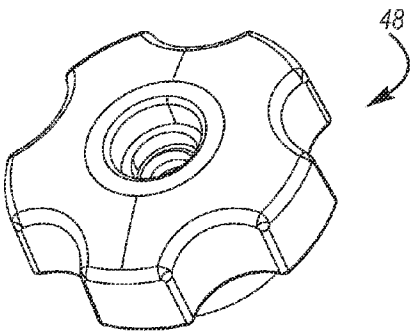
FIG. 10 is a perspective view of a portion of the sports system shown in FIG. 9, illustrating an exemplary knob.
Figure 14:
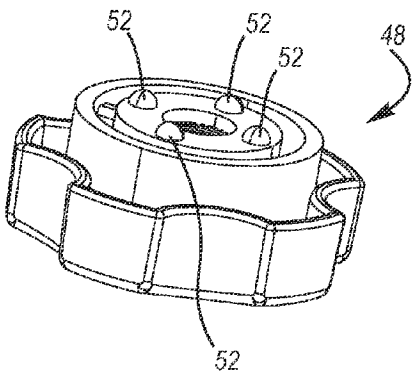
FIG. 14 is a perspective view of the knob shown in FIG. 10.
Figure 13:
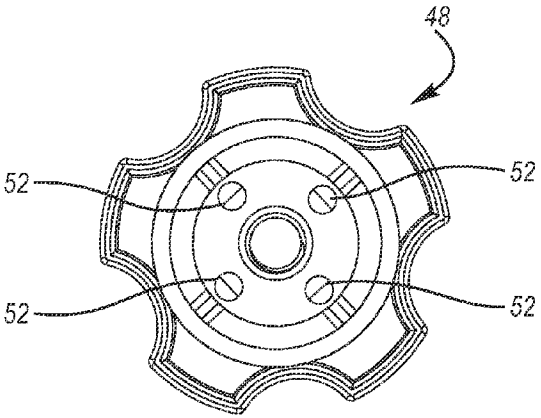
FIG. 13 is a rear view of the knob shown in FIG. 10.

As shown in FIGS. 1 and 7-9, a fastener 44 may be used to interconnect the support members. The fastener 44 may include a bolt 46 and a knob 48 with a threaded portion that is sized and configured to be connected to the bolt. As seen in FIGS. 7-9, the support members 20, 22 may include openings 48, 50 that are sized and configured to receive the bolt 46.

As best seen in FIGS. 11-14, the knob 46 may include one or more protrusions, bumps or engaging portions 52. The protrusions 52 may have a generally rounded and/or dome-shaped configuration. It will be appreciated, however, that the protrusions 52 may have other suitable shapes and configurations. The protrusions 52 may be sized and configured to engage a portion of the support member 20 and/or the support member 22. In particular, as the fastener 44 is tightened, the protrusions 52 may engage a portion 54 of the support member 22 using, for example, a snap, friction and/or interference fit. This may help prevent the knob 48 from unintentionally rotating relative to the support member 22 and/or the bolt 44, which may help prevent the fastener from inadvertently loosening. In addition, as the protrusions 52 engage the portion 54 of the support member 22, the protrusions may deform and/or deflect to further prevent the fastener from unintentionally loosening.

The protrusions 52 are preferably at least substantially equally spaced apart. For example, the knob 48 may include three protrusions 52 at least substantially equally spaced apart in a generally triangle-shaped arrangement, four protrusions at least substantially equally spaced apart in a generally square-shaped arrangement, five protrusions at least substantially equally spaced apart in a generally pentagon-shaped arrangement, etc. It will be appreciated that the knob 48 may include fewer or more protrusions 52 and the protrusions need not be at least substantially equally spaced apart. It will also be appreciated that the sports system 10 does not require the fasteners 36, 40, 42 and that the support members 20, 22, 24, 26 of the support pole 18 may be interconnected using other types of fasteners, adhesives, welding and the like.

As shown in FIG. 1, the goal 16 may include a rim 56, which may also be referred to as a "hoop" or "ring," whether used in connection with a basketball or netball system. The support pole 18 is preferably adjustable in length to allow the height of the goal to be varied. In particular, the support members 20, 22, 24, 26 may allow, for instance, the height of the rim 56 to be adjusted between about 7.5 feet and about 10 feet, which may facilitate use by adults, or between about 4 feet and about 6.5 feet, which may facilitate use by children. The height of the rim 56 may be adjustable in any desired increments and the height of the support pole 18 may depend upon the intended use of the sports system 10.

For example, in order to allow the length of the support pole 18 to be adjusted, it may have a telescoping configuration. In particular, two or more of the support members 20, 22, 24, 26 may telescope relative to each other. Advantageously, this may facilitate shipping of the sports system 10. For example, the support pole 18 may include a first support member with a diameter of about two inches and one or more other support members may have smaller diameters to allow the other support members to be disposed within the first support member. In addition, the support members of the support pole 18 may have a length of about 2.5 feet to position the rim about ten feet above the playing surface, which may facilitate use of the system in connection with playing basketball. This may allow the support pole 18 to be shipped or stored within a support member that has a length of about 2.5 feet and a diameter of about 2 inches. In addition, this compact arrangement of the support pole 18 may be positioned along the side of the base 12 in an exemplary shipping arrangement to help reduce the overall size of the shipping arrangement and thus help reduce shipping costs. It will be understood that the support pole 18 could have other components, shapes, sizes, configurations and arrangements, if desired.

Figure 15:
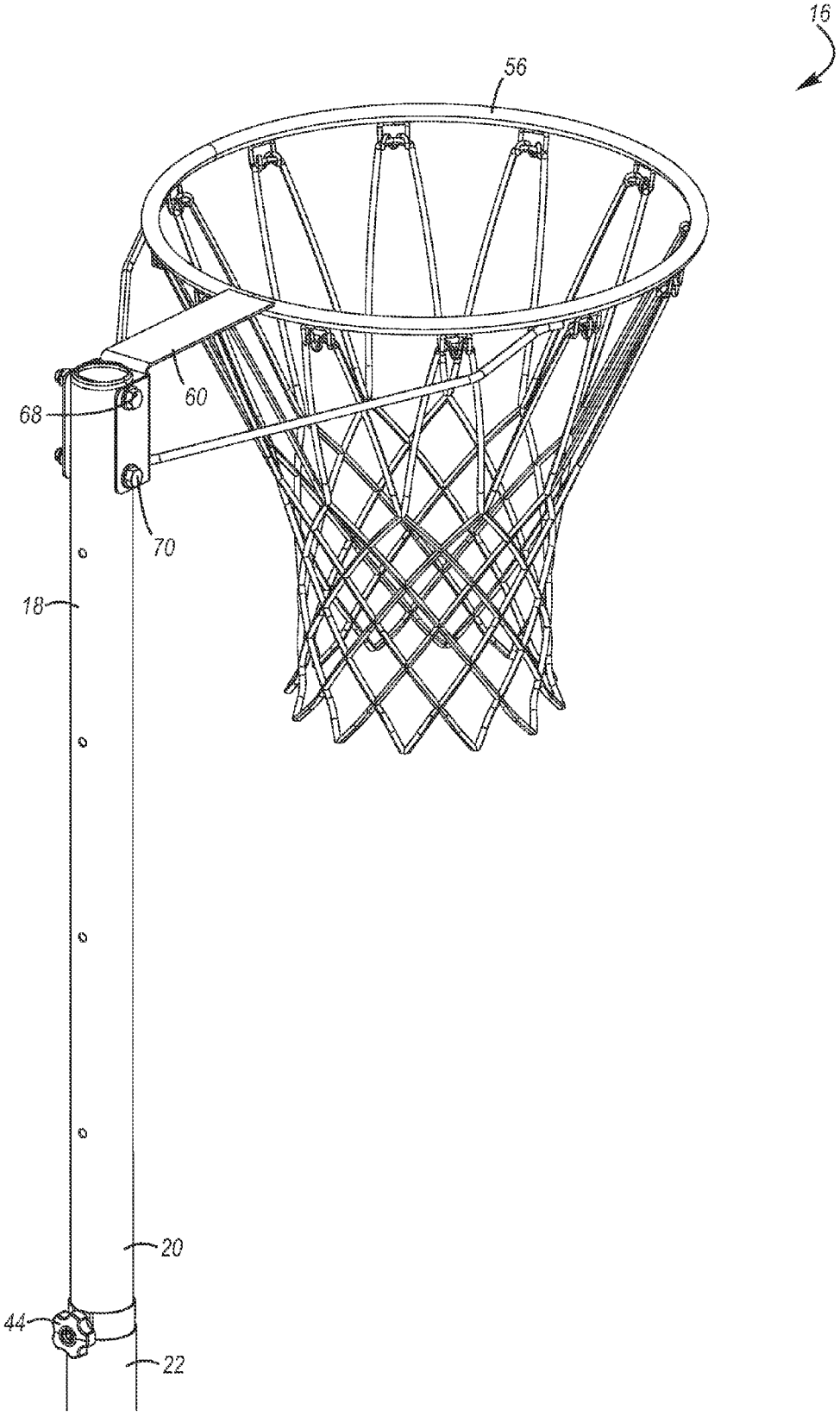
FIG. 15 is an enlarged perspective view of a portion of the sports system shown in FIG. 1.
Figure 16:
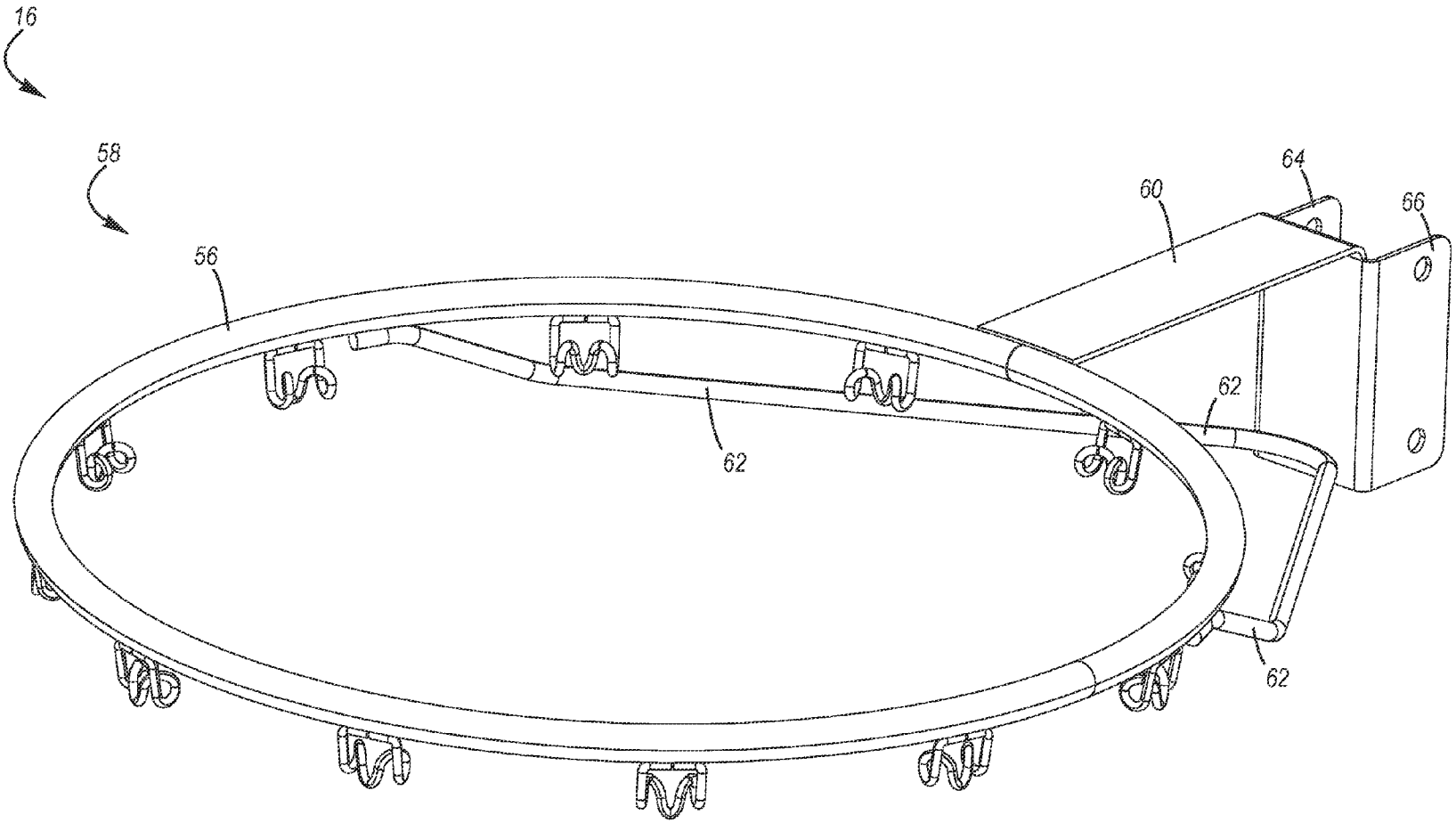
FIG. 16 is a perspective view of a portion of the sports system shown in FIG. 15, illustrating the rim assembly.

As shown in FIGS. 15-16, the goal 16 may include a rim assembly 58 with the rim 56 and a mounting member 60. The rim assembly 58 may also include a brace 62 connected to the rim 56 and the mounting member 60. The mounting member 60 may be sized and configured to be connected to the support pole 18. For example, the mounting member 60 may include a pair of flanges 64, 66 and the flanges and the support pole 18 may include openings that may be aligned to receive one or more fasteners, such as fasteners 68, 70 shown in FIG. 15 or the fastener 44 shown in FIG. 1, to connect the rim assembly 58 to the support pole.

Figure 17:
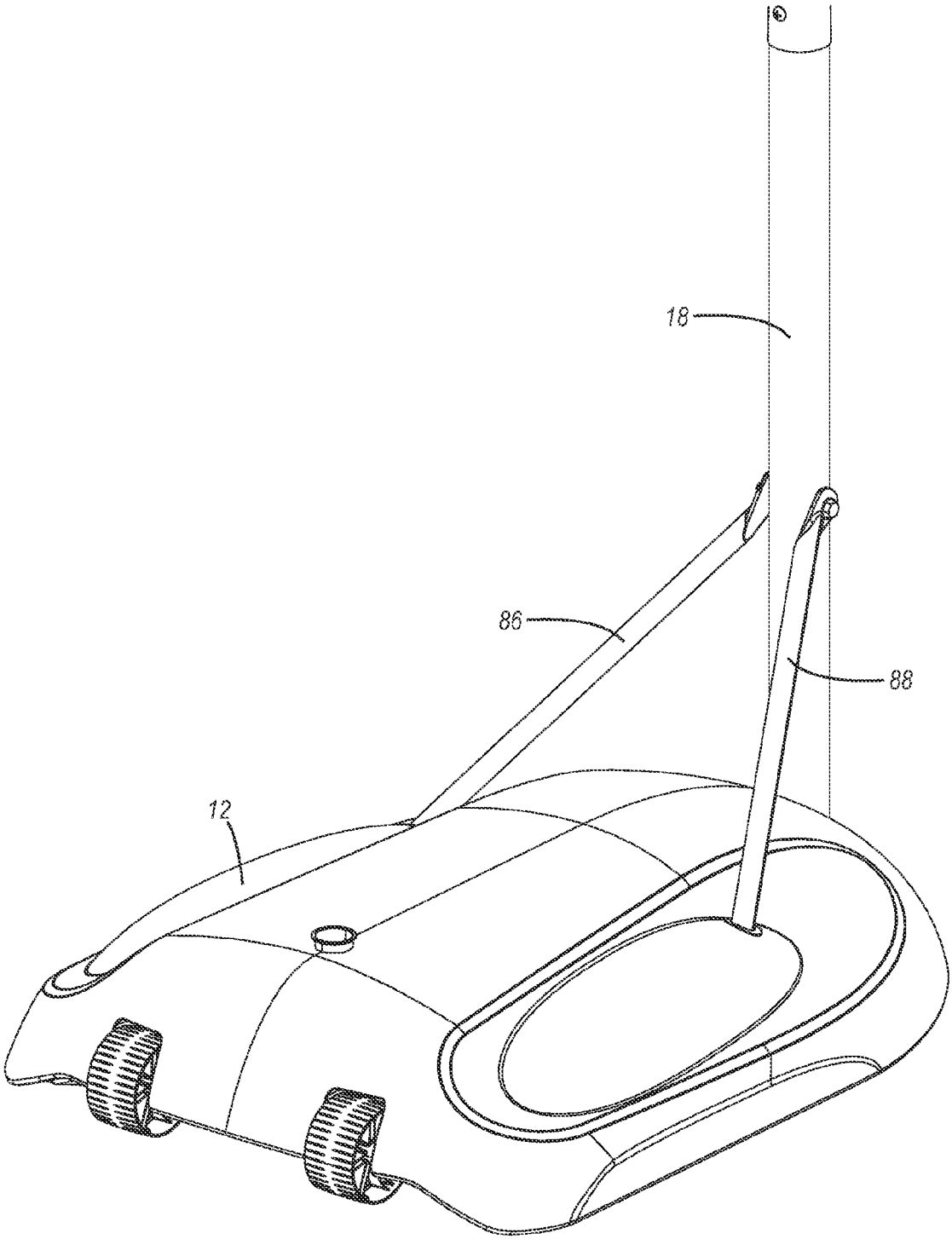
FIG. 17 is an enlarged perspective view of a portion of the sports system shown in FIG. 1, illustrating a portion of the support pole, base and braces.
Figure 18:
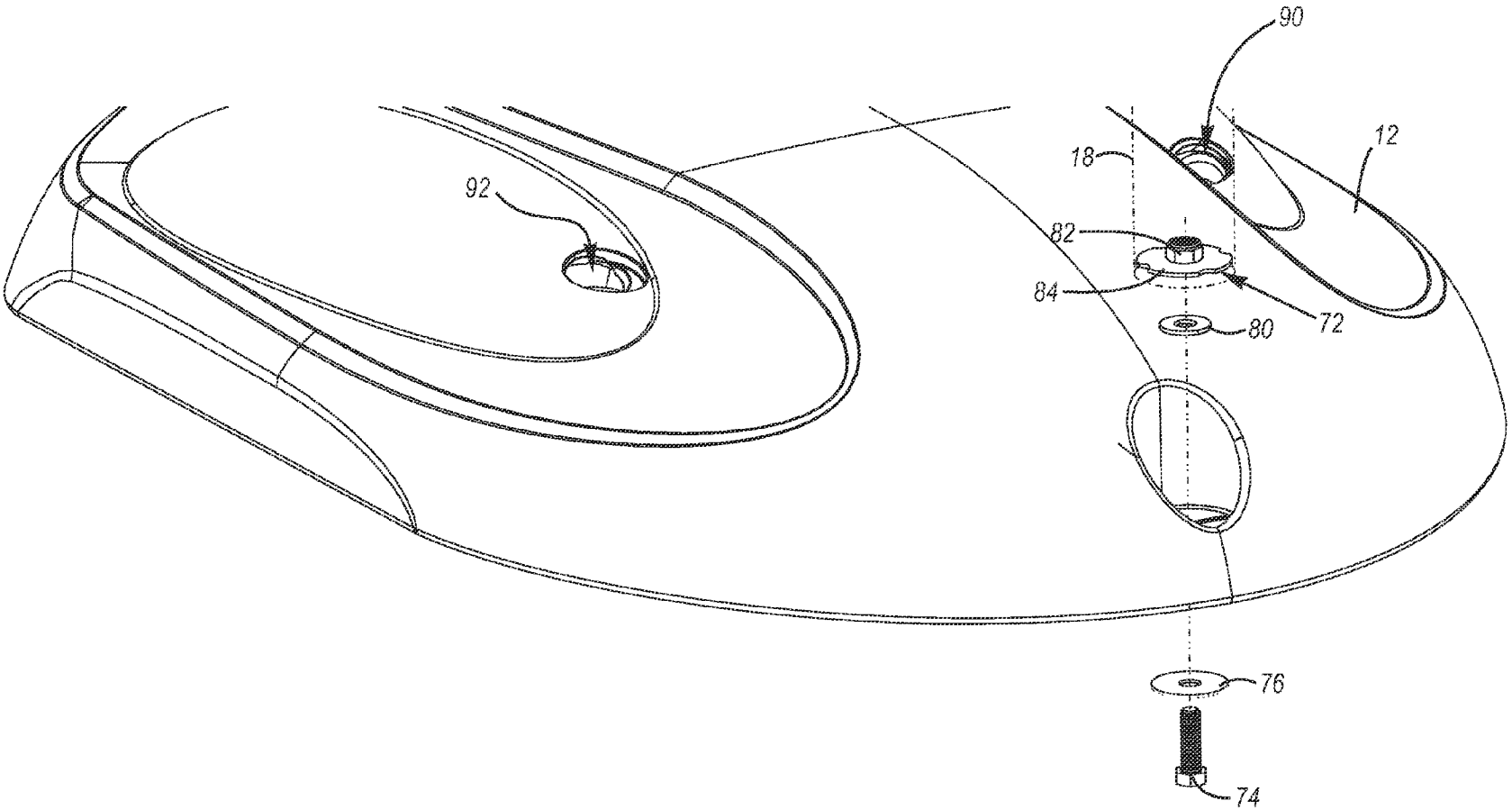
FIG. 18 is an exploded view of a portion of the sports system shown in FIG. 17.
Figure 19:
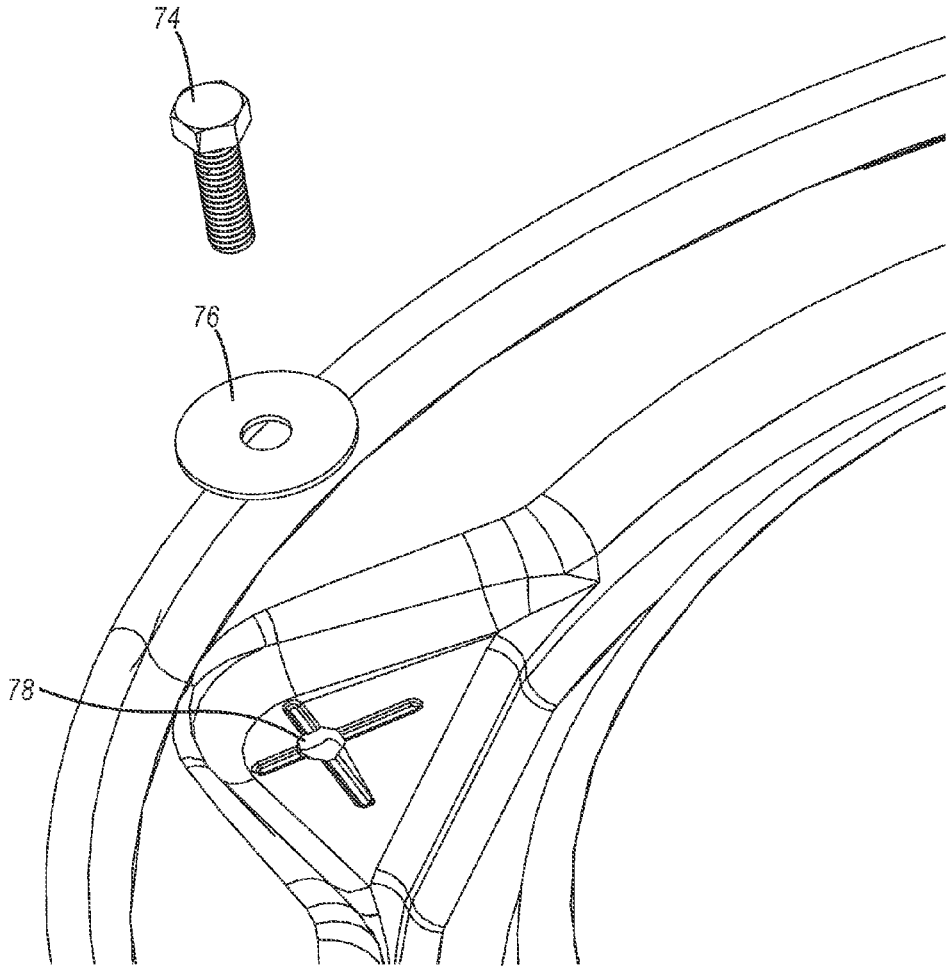
FIG. 19 is an exploded view of a portion of the sports system shown in FIG. 17.
Figure 20:
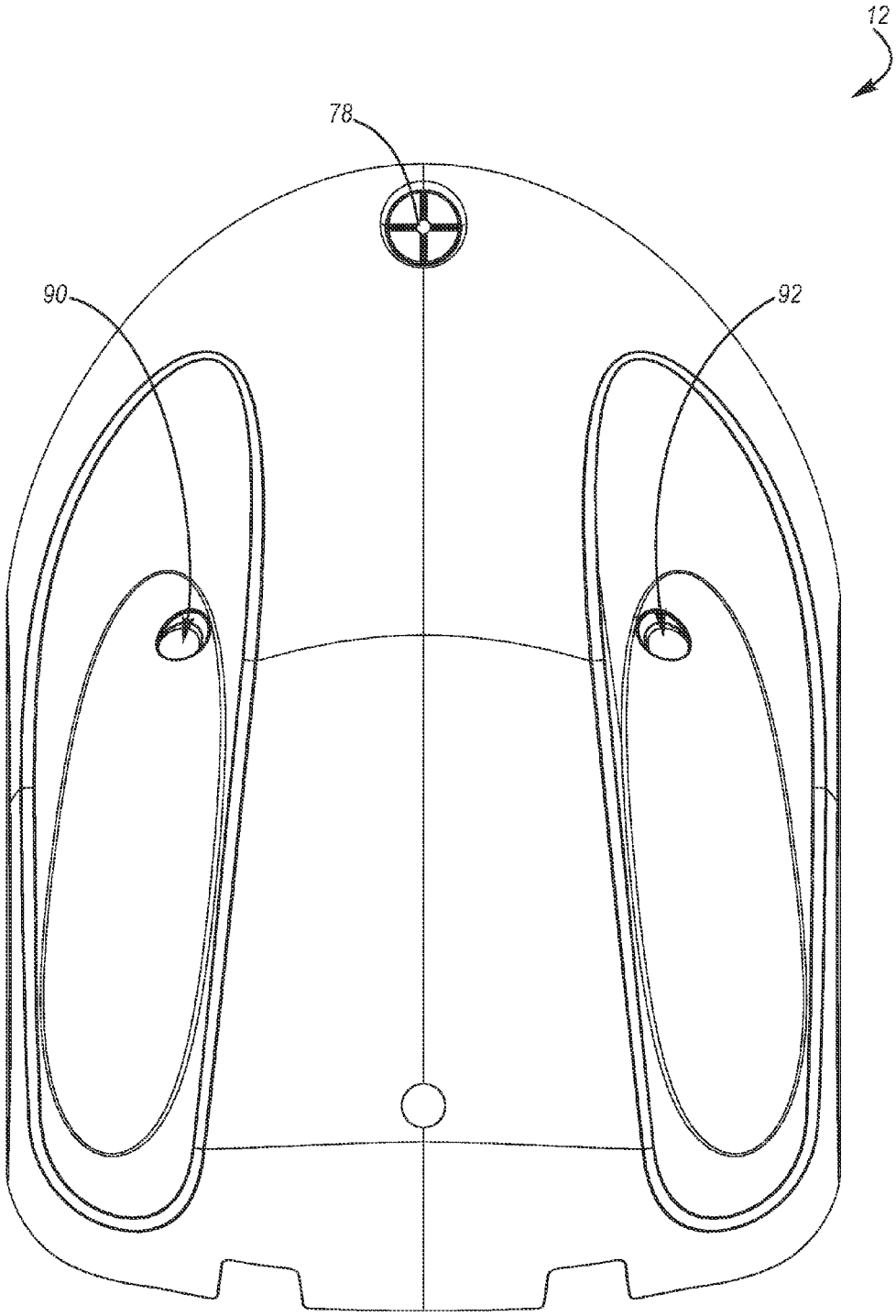
FIG. 20 is a top view of a portion of the sports system shown in FIG. 17, illustrating the base.

The support structure 14 may be connected to the base 12 using one or more one or more fasteners, washers, connectors, and/or other suitable means. For example, as shown in FIGS. 17-19, a connector 72 may be secured to the support pole 18 and a fastener 74 may extend through a washer 76, an opening 78 in the base 12 and/or a washer 80 to engage the connector and connect the support pole to the base. In further detail, the connector 72 may include a nut 82 and a plate 84. The nut 82 may be welded to the plate 84 and the plate may be welded to an interior surface of the support pole 18. The fastener 74 may include a bolt sized and configured to threadably couple the nut 82, and the plate 84 may include an opening through which the bolt may extend in order to couple the nut 82.

Figure 21:
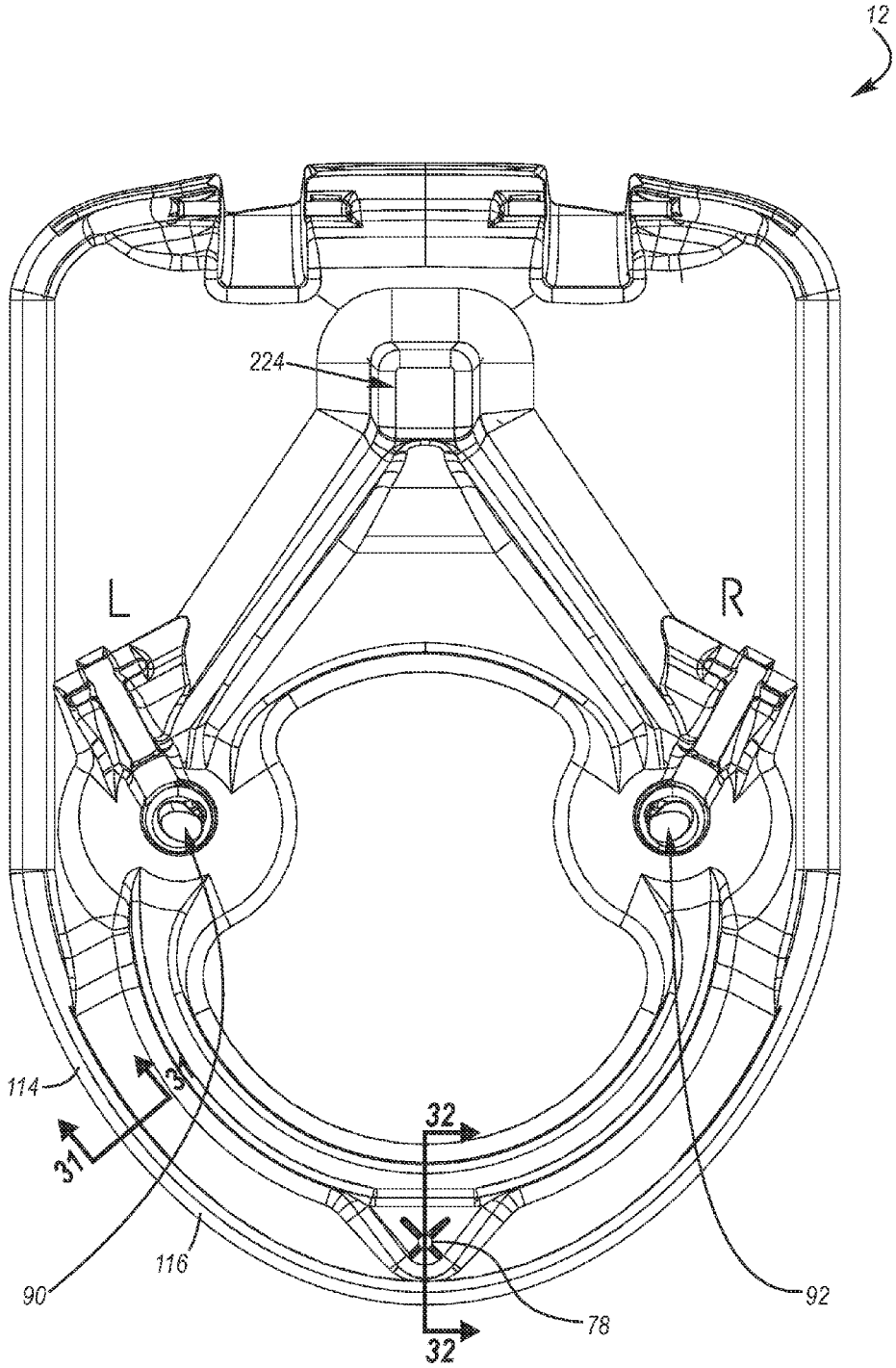
FIG. 21 is a bottom view of the base shown in FIG. 20.
Figure 22:
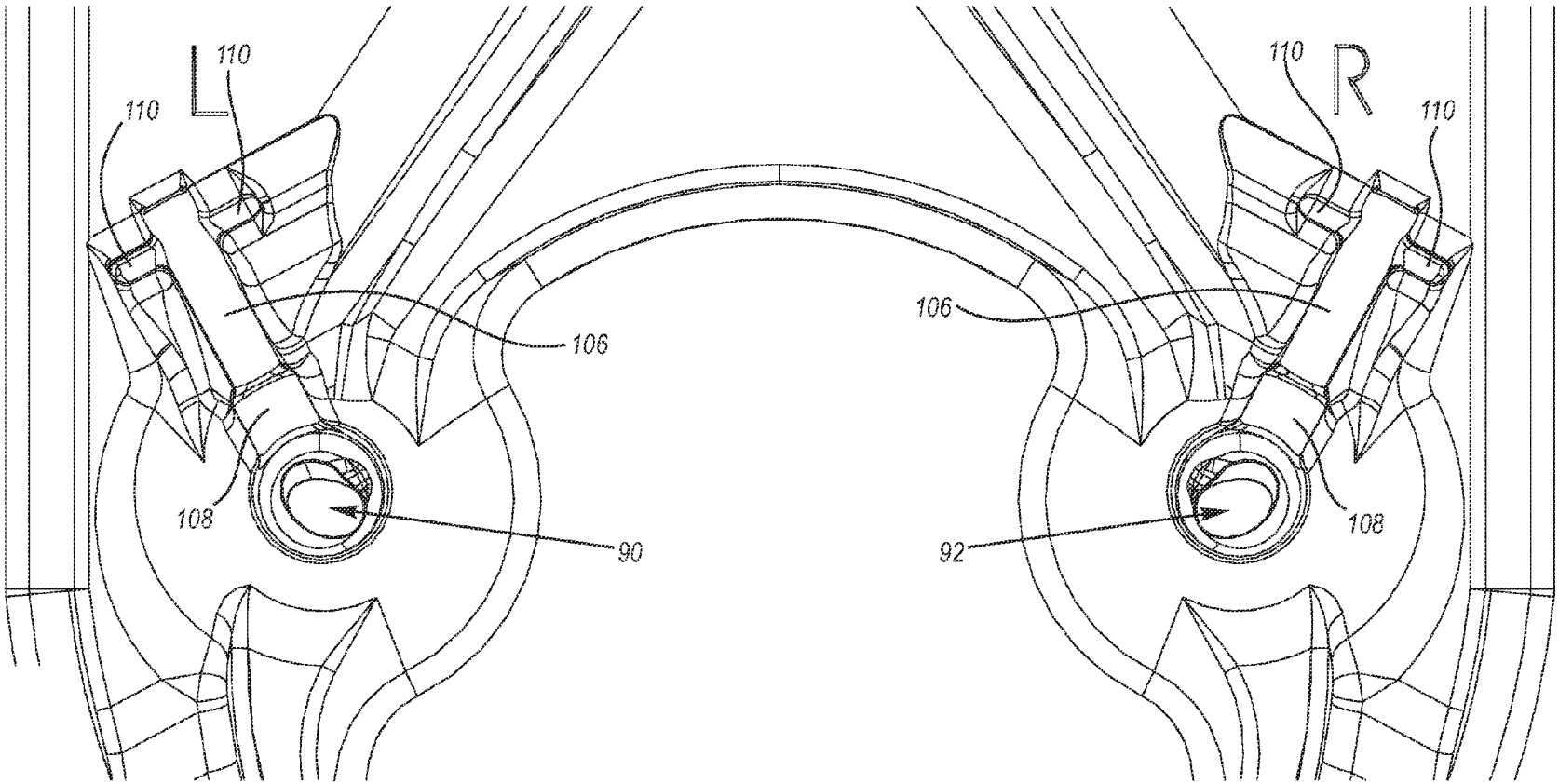
FIG. 22 is an enlarged bottom view of a portion of the base shown in FIG. 21.

As shown in FIG. 17, the sports system 10 may include braces or connecting members 86, 88, which may be sized and configured to help connect the support structure 14 to the base 12. In particular, the braces 86, 88 may include a first portion connected to the support pole 18 of the support structure 14 and a second portion connected to the base 12. In greater detail, the second portion of each brace may be inserted through a passage or opening in the base 12 and the brace may be secured to a portion of the base. Specifically, as shown in FIGS. 20-24, the base 12 may include passages or openings 90, 92 that may extend through the upper and lower portions or surfaces of the base. The passages 90, 92 may be formed by having the upper and lower portions or surfaces of the base 12 contact or touch and forming an opening at that location. For example, as best seen in FIGS. 21 and 22, the lower surface of the base 12 may include upwardly extending portions and one or more of these portions may contact the upper surface of the base to facilitate forming of the openings 90, 92. It will be appreciated that the openings 90, 92 may be formed by other suitable processes and methods.

As shown in FIGS. 25-30, a first positioning member 94 may also be disposed within the openings 90, 92. Advantageously, the first positioning member 94 may help prevent the braces 86, 88 from damaging the base 12. In addition, the first positioning member 94 may help securely connect the braces 86, 88 to the base. For example, the first positioning member 94 may be part of a positioning system that is sized and configured to secure the braces 86, 88 in a desired position relative to the base 12. The positioning system may also include second positioning members 96 that may be connected to the braces 86, 88 to help secure the braces in the desired position relative to the base 12. The positioning system may further include receiving portions in the base 12 that are sized and configured to receive and/or retain the securing members 96 by, for instance, a snap, friction and/or interference fit.

Figure 26:
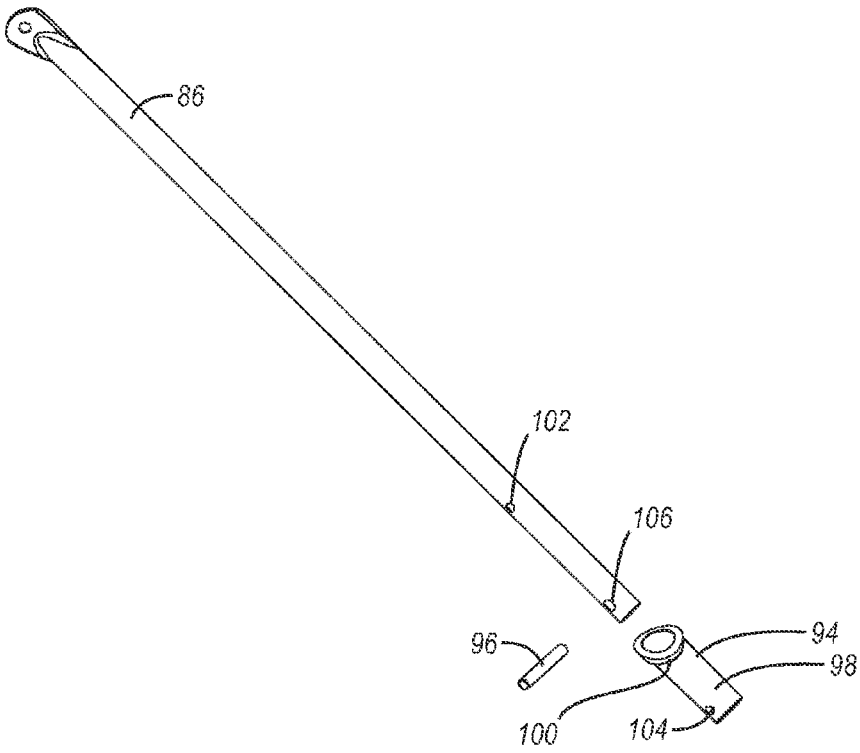
FIG. 26 is an exploded view of a portion of the sports system shown in FIG. 25.
Figure 27:
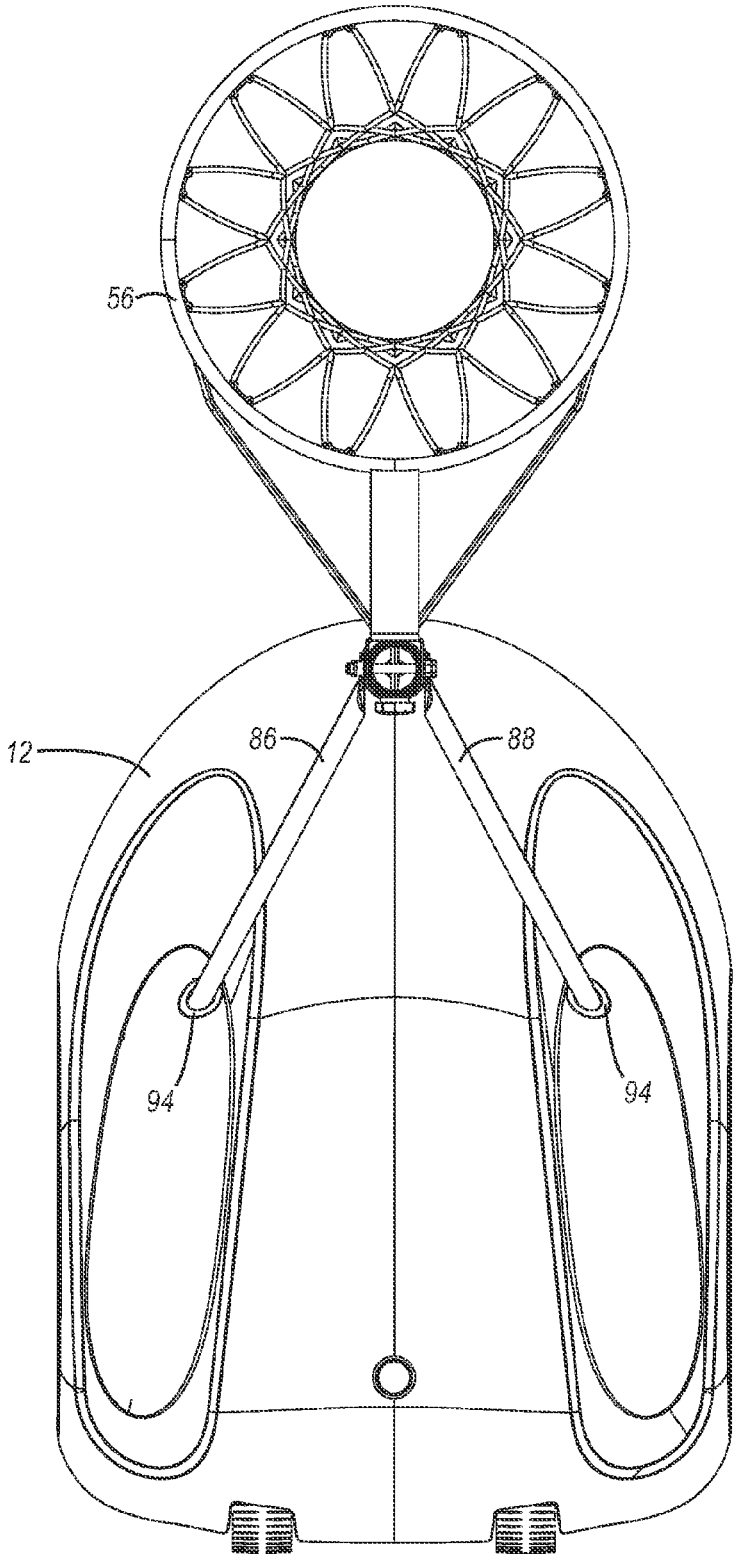
FIG. 27 is a top view of the sports system shown in FIG. 1.

In further detail, as best seen in FIG. 26, the first positioning member 94 may include a sleeve 98 and an outwardly extending annular lip 100. A sleeve 98 is preferably disposed within each of the openings 90, 92 and the lip 100 is preferably disposed within a receiving portion formed in the upper surface or portion of the base 12. The brace 86 is inserted into the sleeve 98 such that openings 102 may be aligned with the openings 104 in the sleeve. One or more fasteners may be inserted into the aligned openings 102, 104 to connect the sleeve 98 and the brace 86. It will be appreciated that the positioning member 94 may have other suitable shapes, sizes, configurations and arrangements depending, for example, upon the intended use of the system 10. It will also be appreciated that the sleeve 98 and the brace 86 may be connected in other appropriate methods and manners.

The end of the brace 86 preferably extends beyond the end of the sleeve 98 and the second positioning member 96 may be connected to openings 106 that are preferably disposed proximate the end of the brace. The positioning member 96 may comprise a pin or other suitable type of member that may be inserted through the openings 106. It will be appreciated that the second positioning member 96 may have a variety of suitable shapes, sizes, configurations and arrangements; and the second positioning member may be connected to the brace by adhesives, welding and the like.

Figure 28:
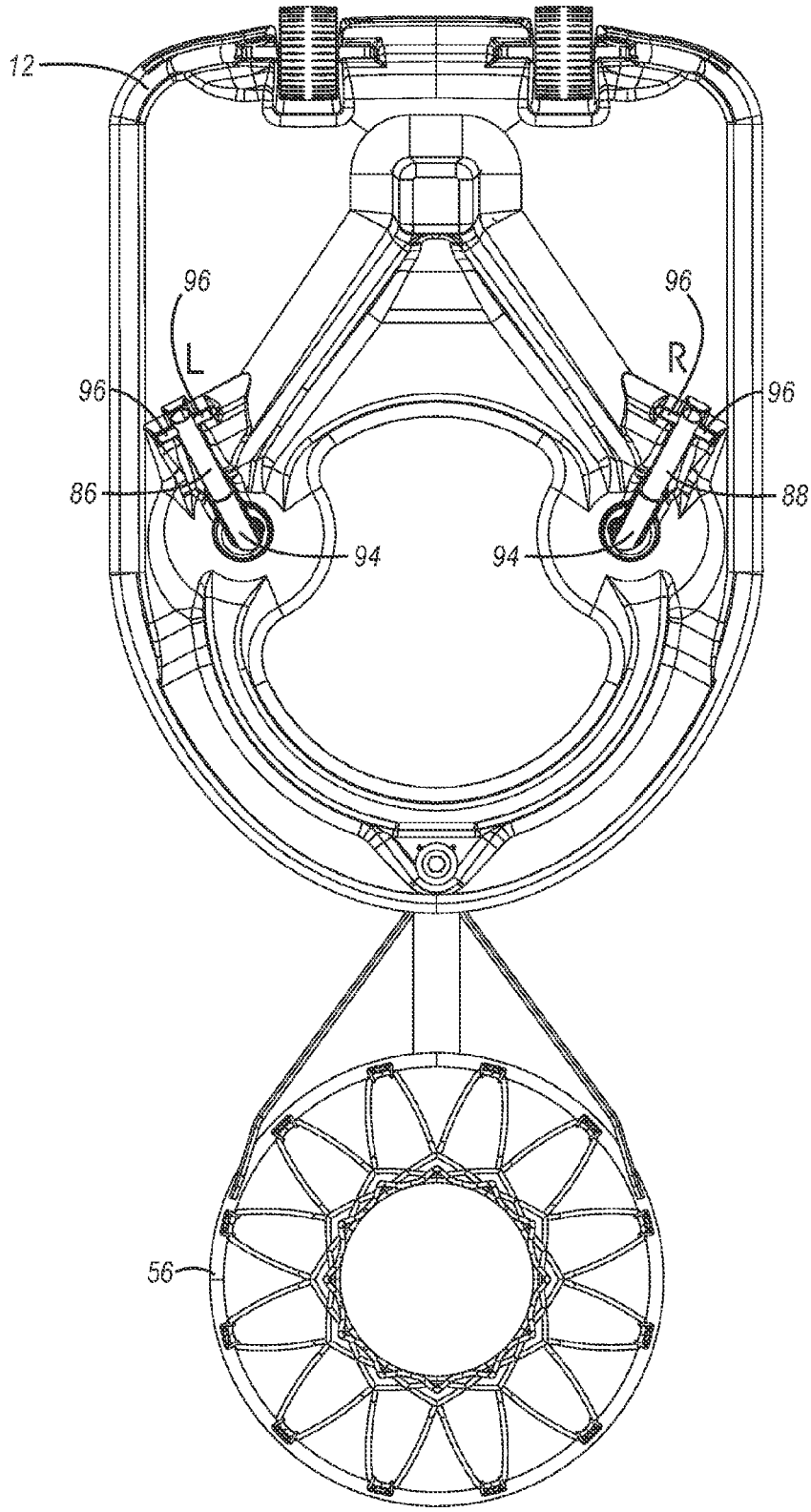
FIG. 28 is a bottom view of the sports system shown in FIG. 1.
Figure 30:
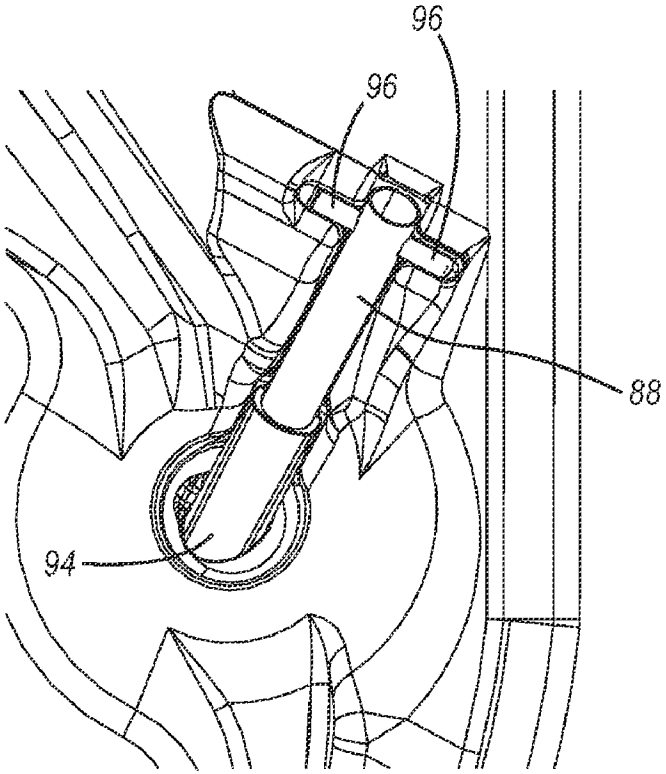
FIG. 30 is another enlarged bottom view of a portion of the sports system shown in FIG. 28.
Figure 29:
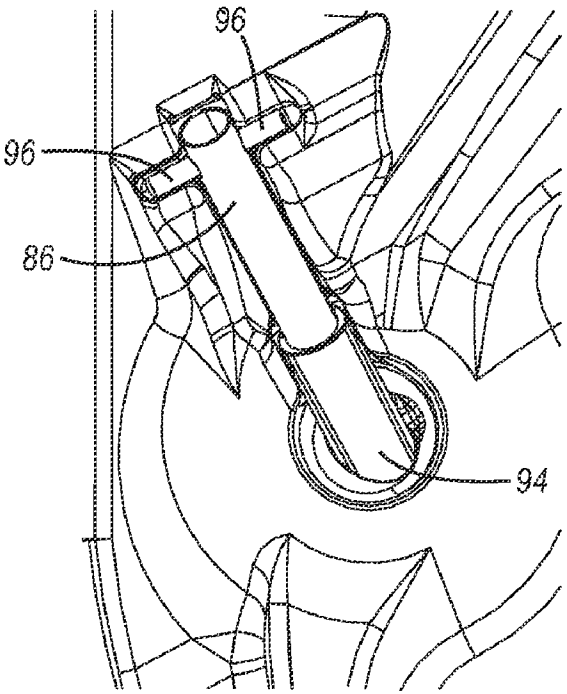
FIG. 29 is an enlarged bottom view of a portion of the sports system shown in FIG. 28.

As best seen in FIGS. 28-30, the pin 96 may be disposed within receiving portions 108, 110 in the base 12. When the pin 96 is disposed within the receiving portions 108, 110, then the braces 86, 88 may not be able to be pulled through the openings. In addition, the pin 96 may be received and retained within the receiving portions 108, 110 by a snap, friction or interference fit, which may also help prevent the braces from being inadvertently removed. Advantageously, the receiving portions 108, 110 may be integrally formed with the base 12, if desired.

In greater detail, the positioning system may allow the braces 86, 88 to be quickly, easily and securely connected to the base 12. For example, the lip 110 of the sleeve 98 may prevent the braces 86, 88 from being further inserted into the base. Additionally, the pin 96 and receiving portions 108, 110 may prevent the braces 86, 88 from being pulled out of the openings 90, 92. Advantageously, the positioning system may also allow the braces 86, 88 to be quickly and easily disconnected from the base 12. In addition, because the lip 110 and/or the pin 96 may contact a relatively large portion of the base 12, that may help prevent the base from being damaged if a large force, for example, is applied to the braces 86, 88. Further, because the lip 110 may contact a first receiving portion formed in the upper surface of the base 12 and the lower surface of the base may be connected to and/or directly support that portion of the upper surface, the base may be unlikely to be damaged and the sleeve 98 may be securely supported. Additionally, because the pin 96 may be disposed in receiving portions 108, 110 that are spaced apart from the openings 90, 92 and the lip 100, forces applied to the receiving portions are unlikely to significantly the portion of the base including the openings 90, 92. Thus, the base 12 may be unlikely to be damaged because the braces 86, 88 are supported by two different portions of the base.

As shown in the accompanying figures, the support structure 14 and the braces 86, 88 are preferably connected to portions of the base 12 that are disposed below the top portion of the base. It will be appreciated, however, that the support structure 14 and the braces 86, 88 may be connected to the top portion and/or any other portion of the base 12.

While the positioning members 94, 96 preferably comprise components that are separate from the braces 86, 88, the positioning members may be integrally formed as part of the brace, if desired. It will be appreciated that the braces 86, 88 and/or positioning members 94, 96 may have other suitable shapes, sizes, configurations and arrangements depending, for example, upon the intended use of the system 10.

If desired, the sports system 10 may include any suitable number braces or connecting members, which may be used to connect the support structure 14 to the base 12. For example, two lower braces and two upper braces may connect the base 12 and the support pole 18. The two lower braces may be generally disposed in the same plane and be connected to a lower portion of the base 12 and the support pole 18. The two upper braces may be connected to an upper portion of the base 12 and the support pole 18. These braces may help secure the support pole 18 in a desired position. In addition, the lower portion of the support pole 18 and/or the lower braces may be connected to other portions, such as outwardly extending feet. These feet may be sized and configured to help increase the stability of the sports system 10, but the feet are not required.

The sports system 10 may also include other suitable features, aspects and components, such as described in Assignee's co-pending U.S. patent application Ser. No. 11/331,496, which was filed Jan. 12, 2006, U.S. patent publication no. 2006-0194653, entitled BASKETBALL SYSTEM; Assignee's co-pending U.S. patent application Ser. No. 11/682,842, filed Mar. 6, 2007, U.S. patent publication no. 2007-0232421, entitled BASKETBALL SYSTEM; and Assignee's co-pending U.S. patent application Ser. No. 11/734,227, filed Apr. 11, 2007, U.S. patent publication no. 2007-0238559, entitled BASKETBALL SYSTEM. These applications are incorporated by reference in their entireties.

Figure 31:
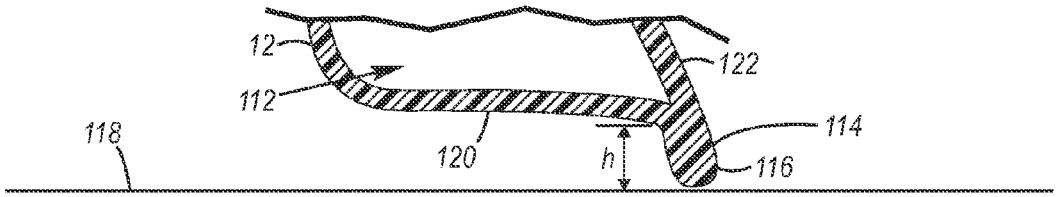
FIG. 31 is a cross-sectional side view of a portion of the base shown in FIG. 17, illustrating a lower portion of the base and an edge or lip.
Figure 32:
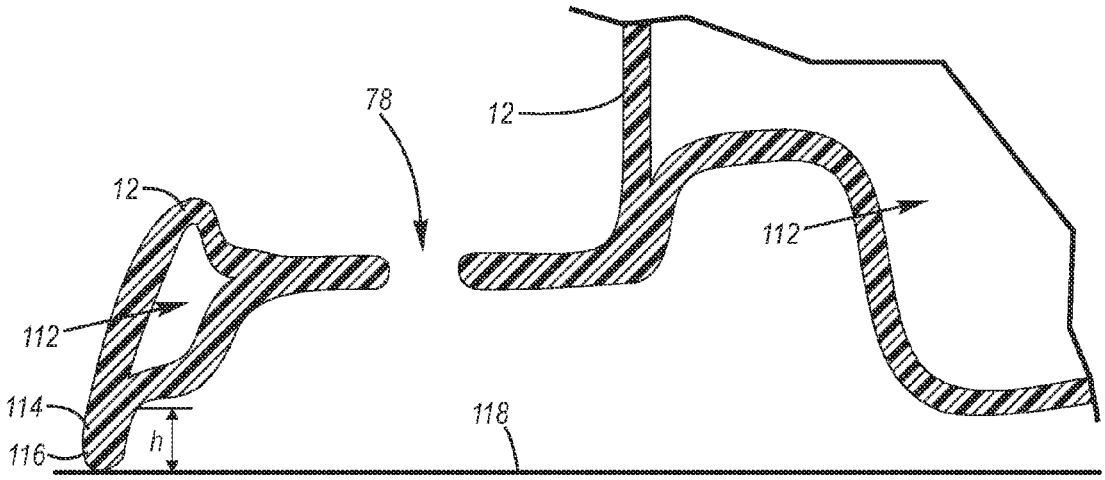
FIG. 32 is a cross-sectional side view of a portion of the base shown in FIG. 17, illustrating an other lower portion of the base and edge or lip.

As shown in FIGS. 21 and 31-32, the base 12 may include a hollow interior portion 112, which may be sized and configured to receive ballast, such as sand or water. The base 12 may also include a surface or outer portion upon which one or more weights may be placed. The base 12 is preferably constructed of relatively lightweight materials, such as plastic, using a molding process, such as blow-molding. The blow-molded plastic base 12 may be relatively lightweight, which may advantageously reduce shipping costs. It will be appreciated, however, that the base 12 may be constructed from other materials having other suitable characteristics. It will also be appreciated that the base 12 may be constructed using an injection-molding process, other molding processes and/or other manufacturing processes.

As best seen in FIGS. 1 and 17, the base 12 preferably includes a lower surface or portion that is disposed at least proximate the support surface, such as the ground or court, and an upper surface or portion. As shown in the accompanying figures, the base 12 may include an outer edge or periphery and the outer edge preferably defines an outer boundary or footprint for the base. As discussed in more detail below, the outer edge preferably contacts or is disposed at least proximate the support surface. Significantly, this may help prevent items or objects from inadvertently being positioned under an outer portion of the base 12. In addition, this larger footprint may help create a base 12 that is more stable and secure, and it less likely to be unintentionally moved. Further, the outer edge may be formed wherein the upper portion and the lower portion of the base 12 contact or engage. Because the outer edge may be formed by overlapping and contacting portions of the upper and lower portions of the base, the thickness of the outer edge may be generally equal to the thickness of the upper portion and the lower portion of the base. This may make a stronger, more robust and sturdier outer edge because it may have twice the wall thickness of the upper portion or lower portion of the base 12.

In greater detail, the outer edge 114 of the base 12, which may also be referred to as a compression portion or edge, preferably extends along the outer perimeter of the base. The compression portion 114 preferably extends along at least a substantial portion of the base's perimeter and may extend completely around the perimeter of the base 12. As seen in FIGS. 31 and 32, the compression portion 114 may include a downwardly extending protrusion or lip 116. It will be appreciated that the compression portion 114 and/or the lip 116 may be spaced apart from the base's perimeter and may be disposed in any suitable portion of the base 12. It will also be appreciated that the base 12 may include any number of compression portions 114 and/or protrusions 116. As discussed below, the compression portion 114 and/or the protrusion 116 may help increase the durability and stability of the base, may help dispose ballast towards the outer edges of the base and may allow the outer edges of the base to be securely supported.

The compression portion 114 and/or the protrusion 116 are preferably formed by mating, contacting and/or engaging the upper and lower surfaces of the base 12. For example, if the base 12 is constructed from blow-molded plastic, then the upper and lower surfaces may mate, contact and/or engage to form the compression portion 114 and/or the protrusion 116. Preferably, there is no gap or space between the upper and lower surfaces so that the compression portion 114 and/or the protrusion 116 have a thickness that is approximately equal to the thickness of the upper surface and the lower surface. Thus, the compression portion 114 and/or the protrusion 116 preferably have at least a substantially solid construction. Advantageously, the compression portion 114 and/or the protrusion 116 may be integrally formed with the base 12 as part of a unitary, one-piece structure during the manufacturing process.

As shown in FIGS. 31 and 32, the compression portion 114 and/or the protrusion 116 may be sized and configured contact, abut and/or engage a support surface 118. As the compression portion 114 and/or the protrusion 116 rub against the support surface 118, the compression portion 114 and/or the protrusion 116 may wear down, for example, when the base is moved. Because the compression portion 114 and/or the protrusion 116 may increase the time necessary to wear down the compression portion and/or the protrusion, it may increase the overall durability of the base 12. In addition, if all or a portion of the lower portion or surface of the base 12 is spaced apart form the support surface, the compression portion 114 and/or the protrusion 116 may help prevent the lower surface from being damaged. Further, because the compression portion 114 and/or the protrusion 116 may have a thickness that is generally equal to twice the wall thickness of the lower surface of the base 12, the base may have increased durability.

In greater detail, the compression portion 114 and/or the protrusion 116 may have a height h that is measured from the support surface 118 to the lower wall or surface 120 of the base 12. Thus, the lower surface 120 may be spaced apart from the support surface 188 by a distance h. Consequently, the compression portion 114 and/or the protrusion 116 may help protect the base 12 from damage.

As discussed above, the compression portion 114 and/or the protrusion 116 preferably have a thickness that is larger than either the thickness of the lower surface or the upper surface of the base 12. In particular, the compression portion 114 and/or the protrusion 116 preferably have a thickness that is generally equal to the thickness of the lower surface and the upper surface of the base 12. In addition, the compression portion 114 and/or the protrusion 116 preferably have a height h that is at least about two times, at least about three times and/or at least about four times the thickness of the lower surface and/or the upper surface of the base 12. The height h of the compression portion 114 and/or the protrusion 116 may also be larger or smaller, if desired.

As shown in the accompanying figures, the compression portion 114 and/or the protrusion 116 may extend along all or at least a portion of the perimeter of the base 12. This may increase side-to-side stability by providing a wider base 12 and may increase front-to-back stability by providing a longer base. In addition, the compression portion 114 and/or the protrusion 116 may have a smaller radius of curvature that is less susceptible to tipping forces and thus is more stable. Moreover, as the support surface 118 rubs against the compression portion 114 and/or the protrusion 116, the compression portion and/or the protrusion may have a generally flat bottom that may be even less susceptible to such tipping forces.

As shown in FIG. 31, the side wall 122, which may form a portion of the upper surface of the base 12, may extend in a generally outward direction as it downwardly slopes to the compression portion 114 and/or the protrusion 116. This may help configure the hollow interior portion 112 of the base 12 such that more ballast may be disposed proximate the outer edges of the base, which may further stabilize the sports system 10. In addition, because the compression portion 114 and/or the protrusion 116 may extend lower than all or a portion the lower surface of the base 12, the compression portion and/or the protrusion may support all or a portion of the weight of the base and ballast. This may help facilitate a secure and stable base 12.

Desirably, the hollow interior portion 112, the lower wall or bottom surface 120, the sidewall or upper portion 122, the compression portion 114 and/or the protrusion 116 may be integrally formed as part of a unitary, one-piece structure. For example, the base 12 may be constructed from blow-molded plastic and the hollow interior portion 112, the lower wall 120, the sidewall 122, the compression portion 114 and/or the protrusion 116 may be integrally formed as part of a unitary, one-piece structure during the blow-molding process. Forming these components as part of a unitary, one-piece structure may advantageously allow these components to be quickly and easily manufactured. In addition, forming these components as part of a unitary, one-piece structure may increase the strength and/or durability of the base 12. It will be appreciated that the hollow interior portion 112, the wall 120, the wall 122, the compression portion 114 and/or the protrusion 116 may be integrally formed as part of a unitary, one-piece structure using other suitable molding and/or manufacturing processes. It will also be appreciated that the hollow interior portion 112, the wall 120, the wall 122, the compression portion 114 and/or the protrusion 116 need not be integrally formed as part of a unitary, one-piece structure and may comprise discrete components.

As mentioned above, the compression portion 114 and/or the protrusion 116 may have an at least substantially solid construction and may be sized and configured contact, abut and/or engage a support surface 118. Desirably, this at least substantially solid construction may be formed during the blow-molding process. In particular, the compression portion 114 and/or the protrusion 116 may be blow-molded as an integral part of the base 12. The mold may include a plurality of pieces, which may include a parting line. At least a substantial portion of the parting line may be offset from the center of the base's height. In particular, at least a substantial portion of the parting line may be offset towards and/or disposed at least proximate to a lower portion of the blow-molded plastic base 12, such as the compression portion 114 and/or the protrusion 116. For example, at least half of the parting line may be offset towards and/or disposed at least proximate to a lower portion of the blow-molded plastic base 12. If desired, the parting line may be disposed at or proximate the compression portion 114 and/or the protrusion 116. Disposing the parting line in such locations may help form the compression portion 114 and/or the protrusion 116 with an at least substantially solid construction. In particular, disposing the parting line in such locations may help the blow-molding process provide a compression-molding effect that compresses a portion of the parison into the compression portion 114 and/or the protrusion 116 to create the at least substantially solid construction.

Figure 23:
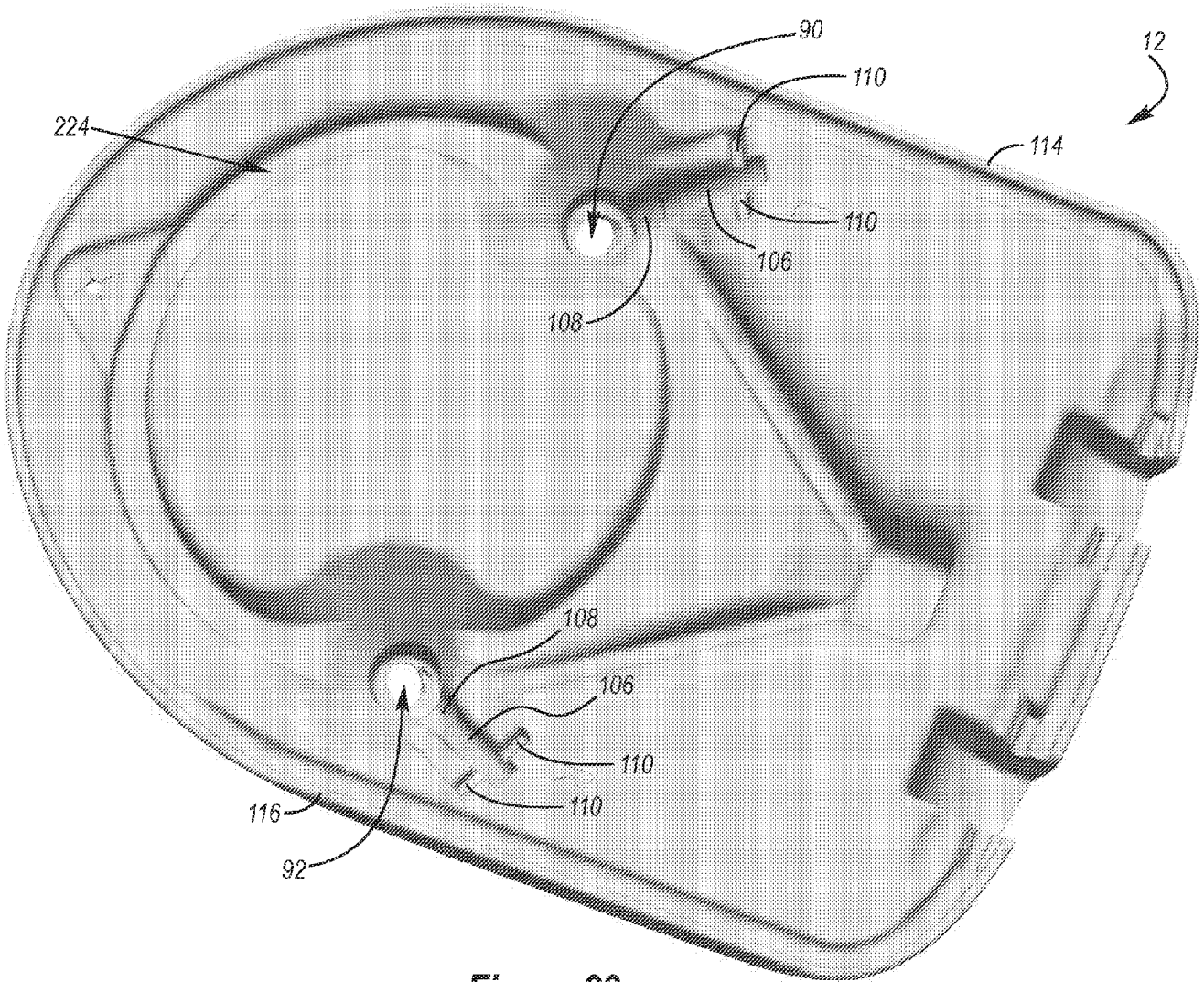
FIG. 23 is a bottom perspective view of a portion of the base shown in FIG. 17.
Figure 24:
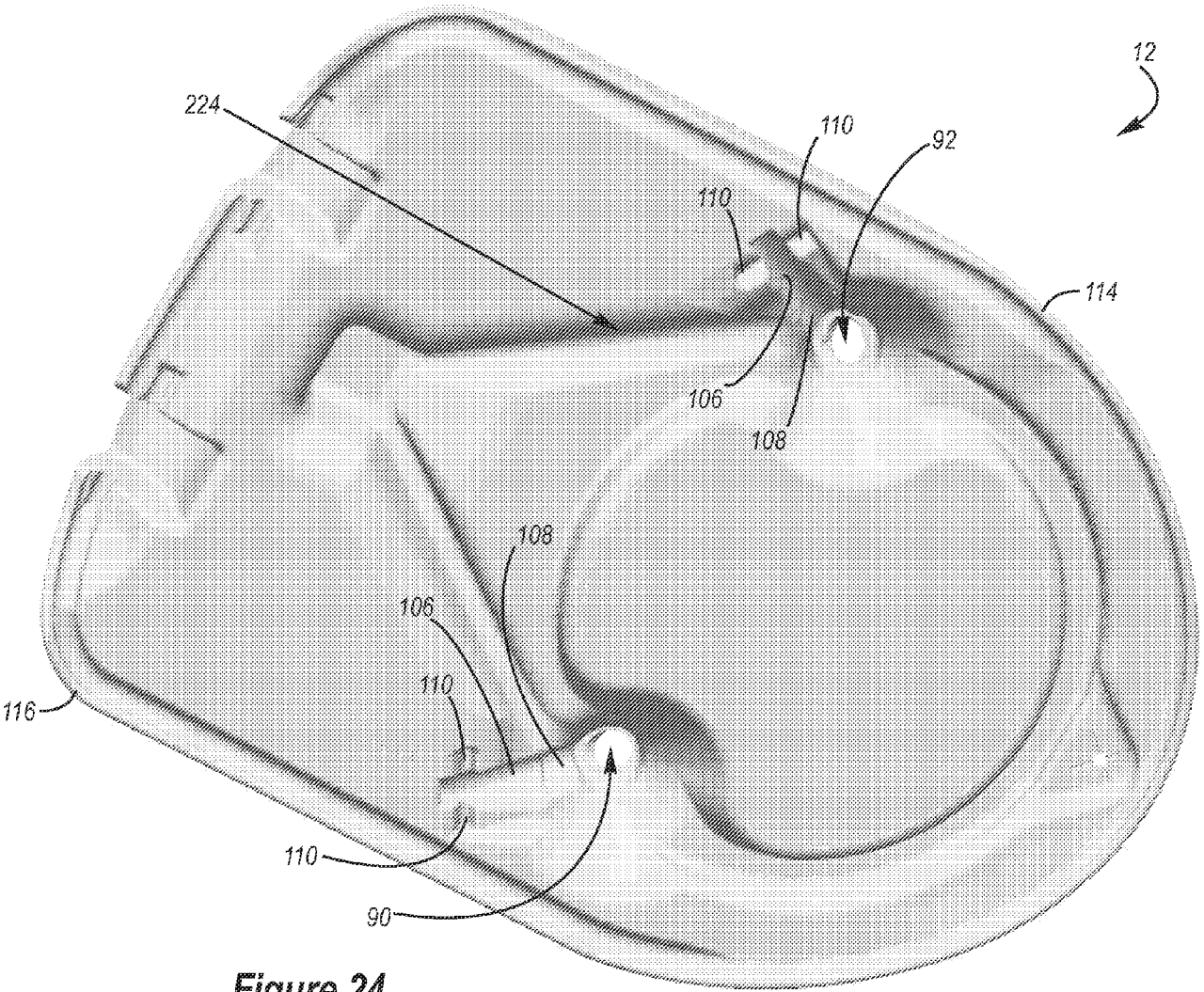
FIG. 24 is another bottom perspective view of the portion of the base shown in FIG. 23.
Figure 25:
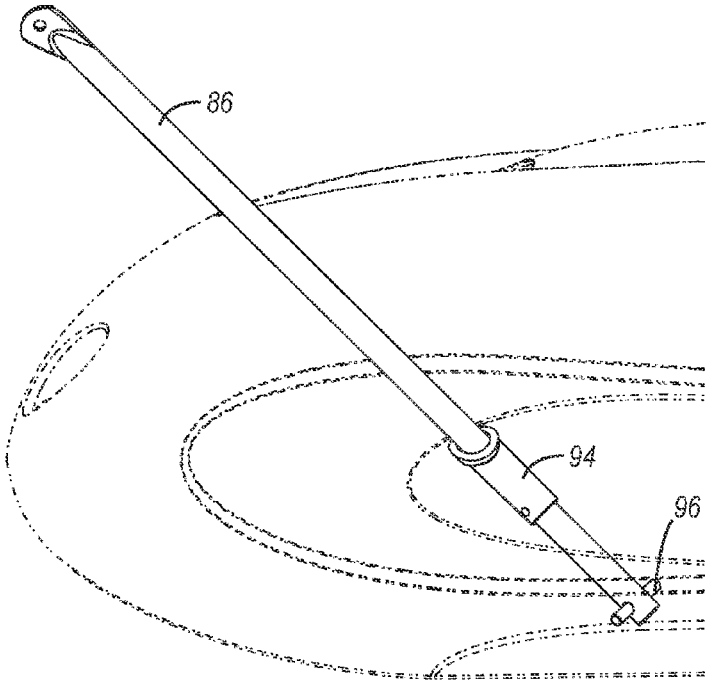
FIG. 25 is a perspective view of a portion of the sports system shown in FIG. 17, illustrating the brace, sleeve and securing member.

As shown in FIGS. 21 and 23-24, the base 12 may include a receiving portion 224 that is sized and configured to receive and/or retain at least a portion of the rim assembly 58, such as the rim 56, the mounting member 60 and/or the brace 62. This may desirably allow the rim assembly 58 and the base 12 to be more compactly shipped, thus reducing shipping costs. The base 12 may also include other suitable aspects, features and components, such as described in Assignee's co-pending U.S. patent application Ser. No. 11/453,327, filed Jun. 14, 2006, U.S. patent publication no. 2006-0293125, entitled BASKETBALL GOAL SYSTEM; and Assignee's co-pending U.S. patent application Ser. No. 11/682,842, which was filed Mar. 6, 2007, U.S. patent publication no. 2007-0232421, entitled BASKETBALL SYSTEM. These applications are incorporated by reference in their entireties.

Figure 33:
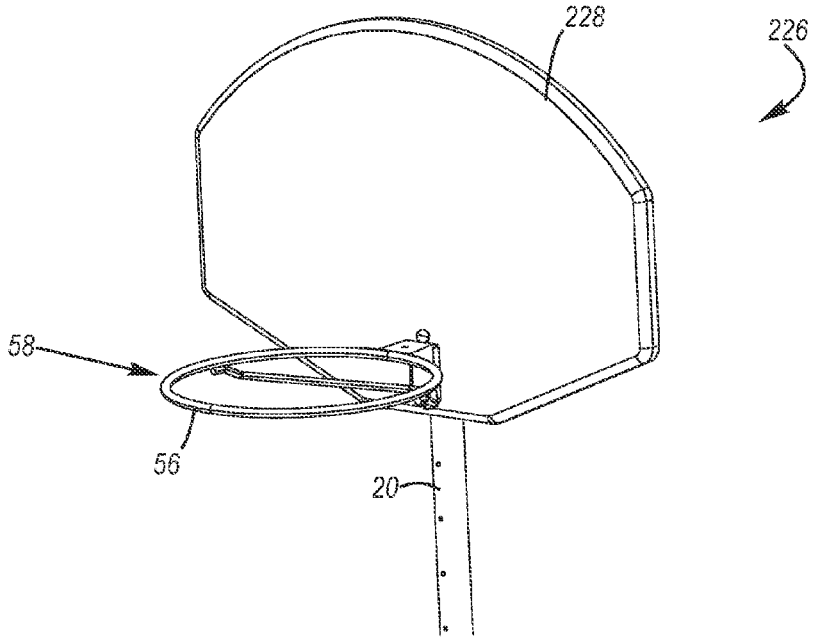
FIG. 33 is a perspective view of an exemplary basketball system.
Figure 34:
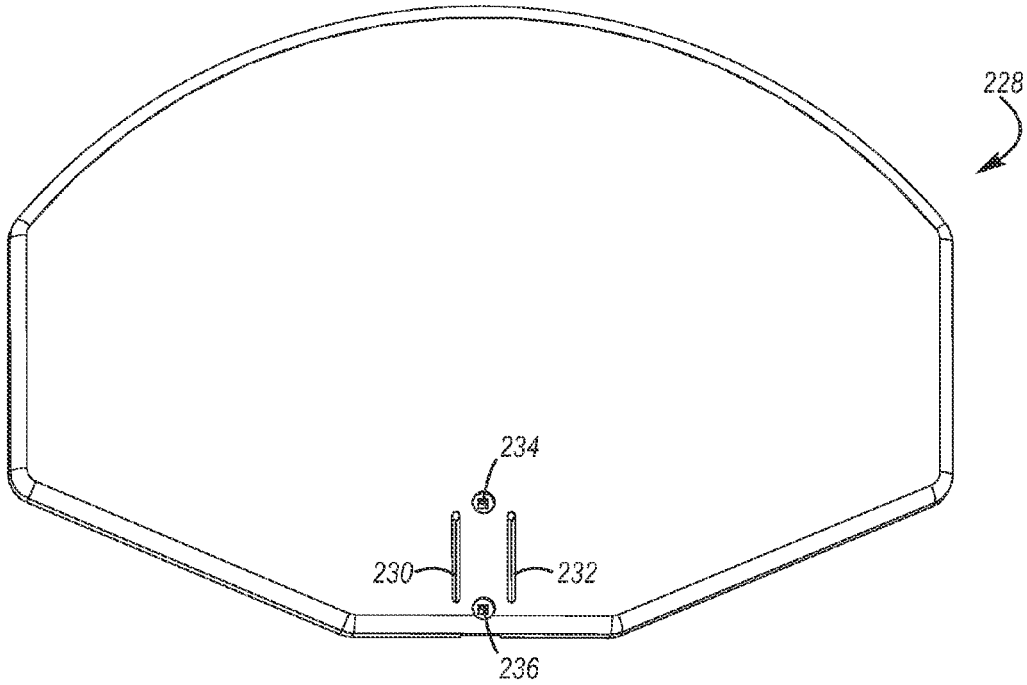
FIG. 34 is a front view the backboard shown in FIG. 33.

The sports system 10 may include relatively few parts and components, which may allow the cost of the system to be decreased. The sports system 10, however, may include other parts and components. For example, the sports system 10 may be configured as a basketball system that, as shown in FIG. 33, includes a basketball goal 226 with a rim 56 and a backboard 228. The backboard 228 may include one or more openings through which at least a portion of the rim assembly 58 may be inserted. In particular, as mentioned above, the rim assembly 58 may include the rim 56 and a mounting member 60. The backboard 226 may include openings 230, 232 through which a portion of the flanges 64, 66 of the mounting member 60 may be respectively inserted for connection to the support pole 18 of the support structure 14. The backboard 226 may also include openings 234, 236 and one or more fasteners may be inserted through the openings to connect the backboard to the support pole 18.

Figure 35:
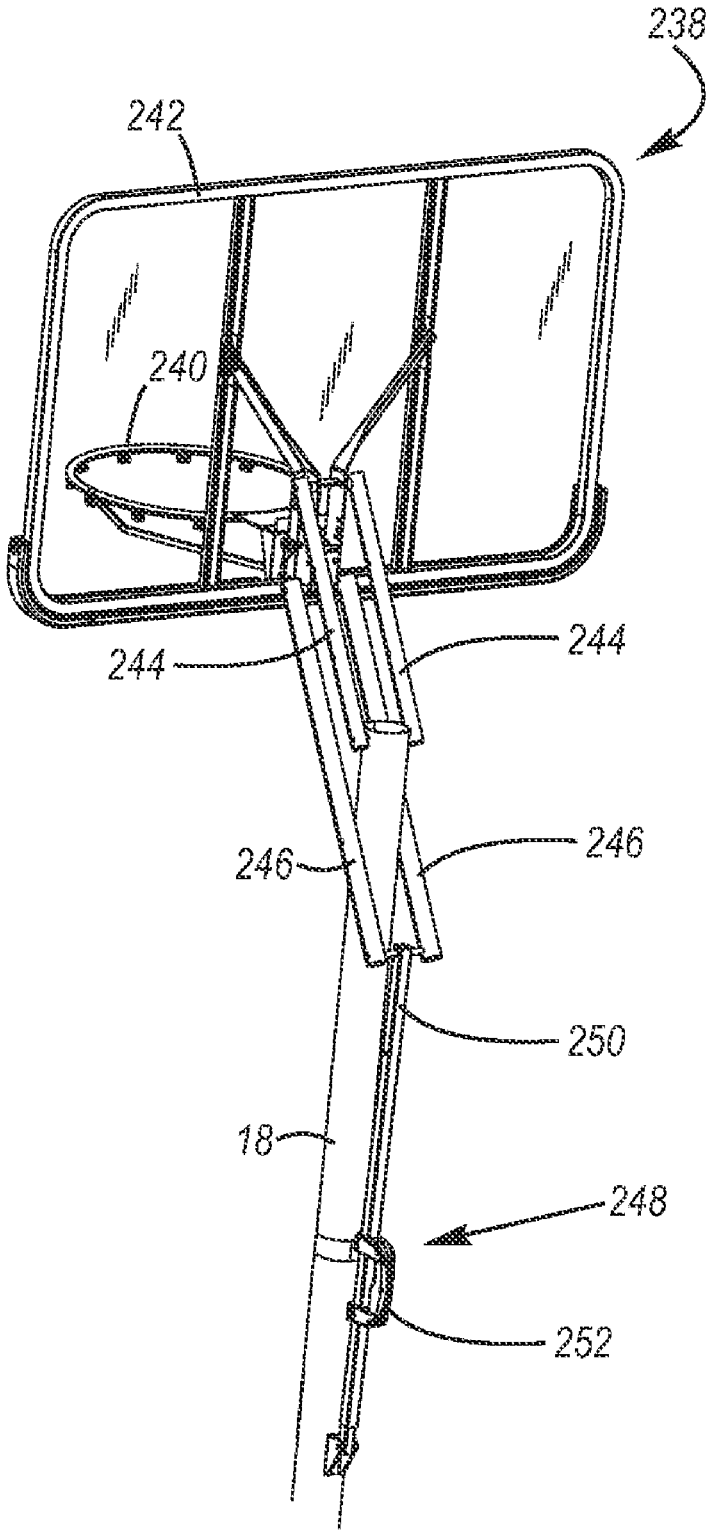
FIG. 35 is perspective view of another exemplary basketball system, illustrating a basketball goal and support structure.

A basketball goal may be connected to the support pole 18 in other suitable fashions using a variety of suitable structures. For example, the sports system 10 may be configured as a basketball system that, as shown in FIG. 35, may include a basketball goal 238 including a rim 240 and a backboard 242. The support structure 14 may include one or more connecting members 244, 246 connected to the basketball goal 238 and to the support pole 18. For example, the support structure 14 may include an upper pair of connecting members 244 and a lower pair of connecting members 246, and the connecting members may include a first portion pivotally or otherwise movably connected to the basketball goal 238 and a second portion pivotally or otherwise movably connected to the support pole 18.

Advantageously, a portion of the basketball goal 238, a connecting member 244, a portion of the support pole 18 and a connecting member 246 may form at least a portion of a four-bar linkage. In addition, the portion of the basketball goal 238, the connecting member 244, the portion of the support pole 18 and the connecting member 246 may have a generally parallelogram configuration. These components may also be pivotally connected to form part of a four-pivot linkage, if desired. It will be appreciated, however, that the connecting members 244, 246 may be connected to the basketball goal 238 and/or the support pole 18 in any other suitable fashion. It will also be appreciated that the sports system 10 does not require the connecting members 244, 246 or any such linkages.

The basketball system 10 may include an adjustment assembly 248 sized and configured to move at least a portion of the support structure 14 to adjust the height of the basketball goal 238. Desirably, this may allow adults, children and/or others to use the sports system 10.

In further detail, the adjustment assembly 248 may include an arm 250, which may be used to move at least a portion of the connecting members 244, 246 to adjust the height of the basketball goal 238. In particular, the arm 250 may be connected to the connecting members 246 and moving the arm may move the connecting members to raise or lower the basketball goal 238. For instance, the arm 250 may be pivotally or otherwise movably connected to the support members 246 and moving the arm downward may raise the basketball goal 238 and moving the arm upward may lower the basketball goal. The adjustment assembly 248 may also include a handle 252 and/or one or more biasing members (such as compression springs, extension springs, torsion springs, leaf springs, gas springs and the like) and the handle and/or the biasing members may be sized and configured to facilitate movement of the arm 250. The biasing members may also be sized and configured to act as a dampener to, for example, at least partially counteract the force of gravity to allow the height of the basketball goal 238 to be more easily adjusted. It will be appreciated, however, that the adjustment assembly 248 does not require the arm 250, the handle 252 or the biasing members and that the adjustment assembly 248 may include a variety of other suitable components having other suitable configurations. It will also be appreciated that the sport system 10 does not require the adjustment assembly 248 and does not require a height-adjustable basketball goal 238.

Desirably, the sports system 10 may be relatively lightweight, which may facilitate shipping, transportation and storage of the system. In addition, the sports system 10 may be packaged within a relatively small, compact area and that may also facilitate shipping, transportation and storage. The relatively small, lightweight packaging may help reduce costs, for example, when shipping the sports system 10 from the factory to the store. In addition, this may allow consumers to easily transport the sports system 10 from the store to their house. Further, because the sports system 10 may be relatively lightweight, that may facilitate quick and easy assembly of the system.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A sports system comprising:

a goal;

a base constructed from plastic, the base comprising:

an upper outer wall;

a lower outer wall;

a hollow interior portion at least partially defined by the upper outer wall and the lower outer wall, the upper outer wall, the lower outer wall and the hollow interior portion being integrally formed during the blow-molding process as part of a unitary, one-piece construction; and an outwardly extending protrusion formed by an overlapping portion of the upper outer wall and a portion of the lower outer wall that are sandwiched together and have an at least substantially solid construction, the protrusion having a thickness generally equal to a thickness of the upper outer wall and the lower outer wall combined together, the protrusion being sized and configured to contact a support surface, the protrusion being integrally formed during the blow-molding process as part of the unitary, one-piece construction; and a support structure connected to the base, the support structure being sized and configured to support the goal at a height above a playing surface.

2. The sports system as in claim 1, wherein the protrusion has a substantially constant thickness.

3. The sports system as in claim 1, wherein the protrusion has a height that is at least four times a thickness of an outer wall of the base.

4. The sports system as in claim 1, wherein the protrusion has a height that is at least three times a thickness of an outer wall of the base.

5. The sports system as in claim 1, wherein the protrusion has a height that is at least two times a thickness of an outer wall of the base.

6. The sports system as in claim 1, wherein the protrusion has a height that is greater than or equal to a thickness of an outer wall of the base.

7. The sports system as in claim 1, wherein the protrusion extends downwardly relative to the lower outer wall of the base and the protrusion forms an outer boundary of the base.

8. The sports system as in claim 1, wherein the protrusion has a thickness generally equal to twice an outer wall thickness of the base.

9. The sports system as in claim 1, wherein the protrusion forms a compression edge of the base.

10. The sports system as in claim 1, further comprising:

a first positioning member comprising a sleeve and a lip extending away from the sleeve;

a brace connected to the first positioning member, the brace including a first portion and a second portion, the first portion of the brace being connected to the support structure, the second portion of the brace being inserted through the sleeve;

a passage extending through an upper portion of the base and a lower portion of the base, at least portion of the brace being disposed within the passage, at least portion of the sleeve of the first positioning member being disposed within the passage, the lip of the first positioning member abutting the upper portion of the base;

a second positioning member connected to the brace, the second positioning member comprising a pin inserted through at least one opening formed in the second portion of the brace; and a receiving portion formed in base, the receiving portion being sized and configured to retain at least a portion of the pin of the second positioning member using at least one of a snap fit, a friction fit or an interference fit.

11. A base for a sports system that is sized and configured to support a support structure relative to a support surface, the base being constructed from blow-molded plastic, the base comprising:

a body including a lower portion, an upper portion and an outer perimeter, the lower portion being sized and configured to be disposed at least proximate the support surface;

a hollow interior portion that is at least defined by the lower portion and the upper portion, the hollow interior portion being sized and configured to receive ballast; and a generally downwardly extending protrusion that is sized and configured to contact at least a portion of the support surface, the protrusion formed by an overlapping portion of the upper portion and the lower portion of the body that are sandwiched together, the protrusion having an at least substantially solid construction, the protrusion having a thickness generally equal to a thickness of the upper portion and the lower portion of the body combined together, the body, the hollow interior portion and the protrusion being integrally formed as part of a unitary, one-piece construction.

12. The base as in claim 11, wherein the generally downwardly extending protrusion is generally aligned with the outer perimeter of the body.

13. The base as in claim 11, wherein the generally downwardly extending protrusion comprises a lip with a solid construction.

14. The base as in claim 11, wherein the generally downwardly extending protrusion supports at least a significant portion of the base.

15. The base as in claim 11, wherein when ballast is disposed within the hollow interior portion, the generally downwardly extending protrusion supports at least a significant portion of the base and the ballast.

16. The base as in claim 11, wherein a thickness of the lower portion of the body and a thickness of the upper portion of the body are approximately equal.

17. The base as in claim 11, wherein the generally downwardly extending protrusion has a thickness that is approximately equal to twice a thickness of an outer wall of the body.

18. The base as in claim 11, wherein the generally downwardly extending protrusion forms a compression edge with a substantially solid construction.

19. The base as in claim 11, wherein the generally downwardly extending protrusion is formed by an abutting portion of the upper portion and the lower portion of the body during the blow-molding process; and wherein there are no openings between the abutting portion of the upper portion and the lower portion of the body.

20. The base as in claim 11, wherein the generally downwardly extending protrusion forms an outer perimeter of the base.

21. The base as in claim 11, wherein a portion of the upper portion forms a sidewall of the body, the generally downwardly extending protrusion being formed by an overlapping portion of the sidewall and the lower portion of the body that are sandwiched together.

22. The base as in claim 11, wherein the generally downwardly extending protrusion has a height that is generally equal to or greater than a thickness of the generally downwardly extending outer protrusion.

23. The base as in claim 11, wherein the protrusion has a substantially constant thickness.

24. The base as in claim 11, wherein the protrusion has a height that is at least four times a thickness of an outer wall of the base.

25. The base as in claim 11, further comprising a support structure connected to the base and a support system connecting the support structure to the base, the support system comprising:

a brace including a first end and a second end, the first end being connected to the support structure;

an opening in the base, the opening being at least substantially disposed at a position where the lower portion and the upper portion of the body contact, the brace extending through the opening;

an engaging portion connected to the second end of the brace; and a receiving portion formed in the lower portion of the base, the receiving portion being sized and configured to receive the engaging portion within the receiving portion.

26. The base as in claim 25, wherein the engaging portion is disposed within the receiving portion in the lower portion of the body by a snap, friction or interference fit.

27. The base as in claim 25, further comprising a sleeve disposed within the opening in the base, the brace extending through the sleeve and the opening, the brace being connected to the sleeve.

28. The base as in claim 27, further comprising an outwardly extending lip of the sleeve and a receiving portion formed in the upper portion of the body, the lip being disposed within the receiving portion in the upper portion of the body.

29. The base as in claim 28, wherein the receiving portion in the upper portion of the base and the receiving portion in the lower portion of the base are integrally formed with the body as part of the unitary, one-piece construction.

30. The base as in claim 28, wherein the receiving portion in the upper portion of the base and the receiving portion in the lower portion of the base are spaced apart by a distance.

* * * * *